US008261380B2

(12) United States Patent
Ferraresi et al.

(10) Patent No.: US 8,261,380 B2
(45) Date of Patent: Sep. 11, 2012

(54) STRETCHER ACCESSORY FOR TURNING A PATIENT

(75) Inventors: Rodolfo W. Ferraresi, Cumming, GA (US); Mario Cesar Eleonori, Martinez (AR); Eduardo Rene Benzo, Villa Celina (AR)

(73) Assignee: Bedlab, LLC, Cumming, GA (US)

( * ) Notice: Subject to any disclaimer, the term of this patent is extended or adjusted under 35 U.S.C. 154(b) by 215 days.

(21) Appl. No.: 12/788,392

(22) Filed: May 27, 2010

(65) Prior Publication Data

US 2010/0313353 A1 Dec. 16, 2010

Related U.S. Application Data

(60) Provisional application No. 61/186,443, filed on Jun. 12, 2009.

(51) Int. Cl.
*A61G 7/14* (2006.01)

(52) U.S. Cl. ..... 5/83.1; 5/84.1; 5/607

(58) Field of Classification Search ..... 5/607, 609, 5/81.1 R, 83.1, 84.1, 86.1
See application file for complete search history.

(56) References Cited

U.S. PATENT DOCUMENTS

| | | | | |
|---|---|---|---|---|
| 2,613,371 | A | | 10/1952 | Keyes, Jr. |
| 3,238,539 | A | | 3/1966 | Koch |
| 3,302,218 | A | | 2/1967 | Stryker |
| 3,344,445 | A | | 10/1967 | Crawford |
| 3,434,165 | A | | 3/1969 | Keane |
| 3,874,010 | A | | 4/1975 | Geary |
| 3,875,598 | A | | 4/1975 | Foster et al. |
| 3,884,225 | A | | 5/1975 | Witter |
| 3,940,808 | A | | 3/1976 | Petrini |
| 4,084,274 | A | | 4/1978 | Willis et al. |
| 4,244,358 | A | | 1/1981 | Pyers |
| 5,022,810 | A | * | 6/1991 | Sherrow et al. ..... 414/501 |
| 5,155,874 | A | | 10/1992 | Kershaw |
| 5,161,267 | A | | 11/1992 | Smith |
| 5,224,228 | A | * | 7/1993 | Larrimore ..... 5/613 |
| 5,274,862 | A | | 1/1994 | Palmer, Jr. et al. |
| 5,315,723 | A | | 5/1994 | Smith |
| 5,487,195 | A | * | 1/1996 | Ray ..... 5/83.1 |
| 5,544,371 | A | | 8/1996 | Fuller |
| 5,640,729 | A | | 6/1997 | Mariño |
| 5,659,905 | A | | 8/1997 | Palmer, Jr. et al. |
| 5,673,443 | A | | 10/1997 | Marmor |
| 5,704,081 | A | | 1/1998 | Bollinger |
| 5,781,949 | A | | 7/1998 | Weismiller et al. |
| 6,131,215 | A | * | 10/2000 | Lindell ..... 5/86.1 |

(Continued)

FOREIGN PATENT DOCUMENTS

EP 1364635 A1 11/2003

(Continued)

*Primary Examiner* — Michael Trettel
(74) *Attorney, Agent, or Firm* — Eric W. Cernyar

(57) ABSTRACT

A stretcher is provided as an accessory to a bed to facilitate a supine-to-prone or prone-to-supine transfer of a patient from the bed to the stretcher or vice-versa. The stretcher comprises a base frame, anchor means for clamping or otherwise securing the stretcher to a position adjacent the bed, and a patient support litter. The stretcher also includes a mechanical, non-bladder-based lift mechanism operable to preferentially raise either a left longitudinal side, or a right longitudinal side, but not both, of the patient support litter, in order to tilt the patient support litter toward the patient support surface of the adjacent bed. The stretcher is also collapsible for easy storage.

15 Claims, 24 Drawing Sheets

U.S. PATENT DOCUMENTS

| | | | | |
|---|---|---|---|---|
| 6,230,342 | B1 | 5/2001 | Haugs | |
| 6,282,736 | B1 | 9/2001 | Hand et al. | |
| 6,393,636 | B1 | 5/2002 | Wheeler | |
| 6,560,793 | B2 | 5/2003 | Walker | |
| 6,651,281 | B1 | 11/2003 | Figiel | |
| 6,668,396 | B2 | 12/2003 | Wei | |
| 6,671,905 | B2 | 1/2004 | Bartlett et al. | |
| 6,772,456 | B2 | 8/2004 | Votel | |
| 6,966,081 | B1 | 11/2005 | Sharps et al. | |
| 7,028,355 | B2 | 4/2006 | Koga | |
| 7,559,102 | B1 | 7/2009 | Benzo et al. | |
| 8,042,208 | B2 * | 10/2011 | Gilbert et al. | 5/607 |
| 2003/0121098 | A1 * | 7/2003 | Wei | 5/81.1 R |
| 2004/0221388 | A1 | 11/2004 | Votel | |
| 2008/0222811 | A1 | 9/2008 | Gilbert et al. | |
| 2010/0138997 | A1 * | 6/2010 | Hoppner et al. | 5/601 |

FOREIGN PATENT DOCUMENTS

| | | | |
|---|---|---|---|
| WO | WO9722323 | A1 | 6/1997 |

* cited by examiner

STRETCHER ACCESSORY FOR TURNING A PATIENT

RELATED DISCLOSURES

This application claims priority to and herein incorporates by reference U.S. Provisional Patent Application No. 61/186,443, filed on Jun. 12, 2009, entitled "Proning Apparatus."

FIELD OF THE INVENTION

This invention relates generally to patient support systems, and more particularly, to patient support systems capable of turning a patient between the prone and supine positions.

BACKGROUND OF THE INVENTION

Bedridden patients often develop bedsores, circulatory deficiencies, and pulmonary problems due to their immobility.

To address this problem, many hospitals and nursing homes employ nurses, orderlies, or other staff to periodically turn patients between the supine and prone positions.

Some hospitals use very expensive specialty beds to turn patients from side to side or from the supine to the prone positions. These beds, however, are so expensive that they are generally reserved for only the most compromised patients.

Other hospitals use turning frames, like the turning frame illustrated in U.S. Pat. No. 3,302,218 to Stryker. Stryker's turning frame comprises two patient engaging support surfaces operable to enclose a patient and sandwich a patient therein between and then rotate the patient 180°. Similarly, U.S. Pat. No. 3,238,539 to Koch discloses a bed capable of rotating a full 180° about a central longitudinal axis. Koch's bed includes hingedly mounted cushion supports that can be positioned and clamped over the patient before the bed is rotated 180°. U.S. Pat. No. 4,244,358 to Pyers discloses a related rollover traction device.

Other hospitals use super-structures that fit over a bed with lift mechanisms to turn a patient over 180°. An example of such a super-structure and its operation is set forth in U.S. Pat. No. 5,544,371 to Fuller. Other patents also disclose super-structures to lift and/or rotate a patient side to side, but apparently not a full 180°. For example, U.S. Pat. No. 5,673,443 to Marmor discloses a superstructure that is positioned over a bed, and that provides a pull sheet that is slipped underneath a patient and hooked up to a rotating shaft to turn the patient from side to side. U.S. Pat. No. 5,315,723 to Smith also discloses a portable patient turning and lifting framework that is positioned over a bed. Straps of a patient litter are positioned beneath the patient and the patient is lifted above the bed surface. The patient can be lifted and turned from side to side. U.S. Pat. No. 5,155,874 to Kershaw also discloses a large lift device mounted over a bed with a turn-sheet to turn a patient from a back rest position to a side position. But neither Marmor's, Smith's, nor Kershaw's super-structures appear suitable for turning a patient 180° between supine and prone positions.

Some patents disclose hospital beds or operating tables with a pair of patient support platforms to transfer the patient from one platform to the other and turn the patient between supine and prone positions. U.S. Patent Publication No. 2008/0222811 A1 to Gilbert et al. discloses three embodiments of a rotational operating bed with first and second patient support platforms that can be operated to transfer the patient from one of the platforms to the other while turning the patient between the supine and prone positions. The platforms are operable to be positioned or articulated into approximately 90° angles in relation to each other and rotated to facilitate the transfer.

European Patent Application No. 1 364 635 A1 to Vassilli s. r. l. discloses a hospital bed comprising two half-frames that can independently inclined to assist transferring a patient from a lateral position to a seated position. It appears that it may also be operable to assist turning the patient between supine and prone positions.

U.S. Pat. No. 2,613,371 to Keyes discloses a "Turnover Bed" comprising two mattresses set at 90° to each other and supported for rotation on a single horizontal longitudinal axis together with a mechanism for rotating the mattresses together through an arc of 90°. In this manner, a patient lying supine can be rotated 90° to her side, and then pulled over onto her stomach into the prone position. Or a patient lying prone can be rotated 90° onto her side, then pulled over into the supine position.

The Gilbert, Vassilli, and Keyes beds, however, are specialty beds. They are not designed as low-cost accessories to an existing hospital bed.

U.S. Pat. No. 6,966,081 to Sharps et al. describes an elaborate pair of inflatable assemblies. One of the inflatable assemblies is placed on a conventional transport device such a stretcher. The other inflatable assembly is placed a conventional operating room table adjoining the stretcher. The two assemblies are then operated in conjunction to tilt the patient between a supine position and a prone position while transferring the patient between the stretcher and the operating table.

Other patents disclose sheet mechanisms designed for turning a patient between supine and prone positions. U.S. Pat. No. 3,874,010 to Geary, and especially FIG. 8, discloses a bed with a first sheet that passes from a first reel at a first side of the bed underneath and over the patient and back to a second reel on the first side of the bed, the first sheet is also connected to a second sheet that is wound at an opposite end to its connection with the first sheet to a third reel on the second side of the bed. The reels are operated by motors to rotate a patient enclosed within the first sheet between supine and prone positions. U.S. Pat. No. 5,659,905 to Palmer, and in particular FIGS. 9-15, discloses a system involving a sheet operated by rollers on each side of a bed's mattress to rotate a patient between the prone and supine positions. U.S. Pat. No. 5,274,862 to Palmer also discloses a patient rotation system based on a conceptually similar approach.

U.S. Pat. No. 3,884,225 to Witter discloses a flexible sheet designed to be wrapped around the patient and connected on both sides via fasteners to the right or left bed rail. To turn a patient over, the top flap of the sheet is transferred over to the opposite bed rail, and then the bottom flap of the sheet is pulled to also connect it to the opposite bed rail, turning the patient in the process. U.S. Pat. No. 6,560,793 to Walker discloses a draw sheet that operates according to a similar approach.

U.S. Pat. No. 6,772,456 to Votel discloses a patient transfer device that includes a sheet for rolling a patient to a desired position. U.S. Patent Pub. No. 20040221388 to Votel discloses a sheet, sheet gripper, and winch mechanism for a hospital bed to move a patient lying on the sheet. However, it is not clear whether the latter mechanism is capable of or designed for turning a patient between the supine and prone positions.

There is a need for an economic tilt-capable stretcher that can cooperate with an economic patient tilting bed to move a patient between the prone and supine positions.

SUMMARY OF THE INVENTION

The present invention can be characterized as a patient turning accessory for a hospital or nursing home bed. The patient turning accessory may be characterized as a specialized stretcher or an adjustable patient litter. It comprises a transport frame, a mechanically-actuated patient support litter, and a non-air-bladder-based lift mechanism. The patient support litter may comprise a simple sling suspended between two poles or rods, or a mattress mounted over a mattress foundation. Regardless, the patient support litter has a longitudinal adjustable side and a longitudinal relatively fixed side opposite the longitudinal adjustable side. The lift mechanism is operable to preferentially raise the longitudinal adjustable side relative to the relatively fixed side of the mattress foundation, in order to tilt the mattress toward the adjacent bed. The patient support surface is operable to rotate only from a substantially flat to a tilted position in only one direction. The patient support litter, when tilted, assumes an upwardly-facing concave lateral cross-section to partially cradle a person being transferred away from or to the patient support litter.

Preferably, the lift mechanism comprises at least one but preferably two actuator subassemblies. Each actuator subassembly is mounted to an actuator subframe.

The patient turning accessory may be collapsed into a compact storage configuration. Each actuator subframe is pivotally mounted to the transport frame about a vertical axis for movement between an outwardly extended operational position and a retracted storage position. The patient support litter or mattress is also collapsible along one or more longitudinal fold lines for folding the mattress into a compact storage configuration. Also, couplers are provided to pivotally and detachably couple the lift mechanism to the adjustable side of the mattress foundation, so that it can be detached from the lift mechanism and folded over the mattress, when the mattress is folded into a compact storage configuration.

In one embodiment, each actuator comprises a sliding element, a sliding guide, a principal telescoping arm, and a secondary arm. The sliding guide confines the movement of the sliding element. The principal telescoping arm has superior and inferior ends, the inferior end of which is hingedly linked to the sliding element, and the superior end of which is coupled to the left longitudinal side or right longitudinal side of the patient support surface. The secondary arm also has superior and inferior ends, the inferior end of which is hingedly linked to a section of the base frame and the superior end of which is hingedly joined to a midsection of the principal arm.

The present invention can also be characterized as a patient rotation accessory for receiving a patient from, or transferring a patient to, another patient support surface, while turning the patient between the supine and prone positions. The patient support accessory comprises a transport frame, a mechanically-actuated patient support litter, and a lift mechanism. The lift mechanism is operable to raise and move inward a side of the patient support litter to a substantially vertical orientation—but in only one of the right or left directions, not both directions—to receive a patient from, or transfer a patient to, another adjacently-placed patient support surface, while simultaneously turning the patient between the supine and prone positions.

The present invention can also be characterized as a method for rotating a patient between supine and prone positions. One step comprises obtaining a portable stretcher having a patient support litter and a mechanical lift mechanism for turning the patient support litter about a longitudinal axis. Another step comprises wheeling the portable stretcher adjacent the first patient support surface. Additional steps comprise tilting the patient support litter toward the first patient support surface, and tilting the first patient support surface toward the patient support litter. In this manner, both the first patient support surface and the patient support litter are tilted toward each other. A subsequent step comprises transferring the patient between the first patient support surface and the patient support litter while turning the patient between the supine and prone positions. Further subsequent steps comprise returning the patient support litter and first patient support surfaces to substantially level positions.

The present invention can also be characterized as a combination of two independently controllable mattresses or patient support surfaces. Each mattress or patient support surface can be tilted independently of its adjoining mattress or patient support surface to facilitate the supine-to-prone or prone-to-supine transfer of a patient from one mattress or patient support surface to the other. Although each mattress and patient support surface is operated to tilt toward the other, the degree and chronological progression of the tilting is staggered, as illustrated in Appendix A to the incorporated provisional patent application. Namely, in a first stage, the receiving mattress is tilted at a greater angle than the transferring mattress. In a second stage, the transferring mattress is tilted to a maximum patient transferring angle, and the patient is transferred to the receiving mattress. Then, in a third stage, the receiving mattress is rotated toward a substantially horizontal position at a more rapid pace and a closer-to-horizontal angle than the transferring mattress. Finally, in a fourth stage, the transferring mattress is rotated back to a substantially horizontal position.

The present invention can be characterized as including—but should not be, unless specified by the claim language, characterized as being limited by—any of the aspects, features, and advantages, separately or in combination, described in this specification. It will be understood that it is the inventors' intent that the scope of any of the claims be defined by the language of the claims, and not narrowed by reference to the preferred embodiments described in the specification.

DETAILED DESCRIPTION OF THE INVENTION

Figure 1:
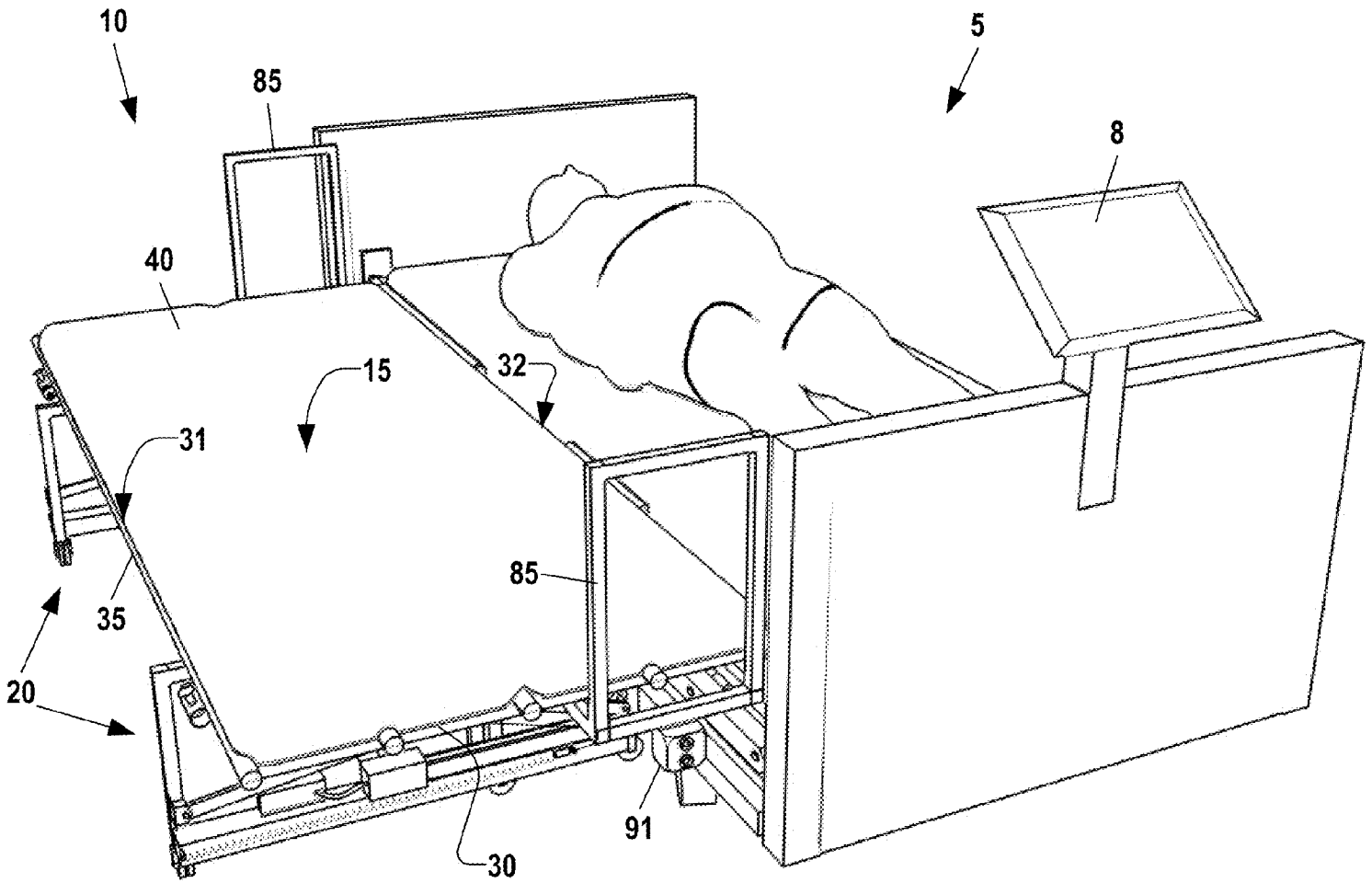
FIGS. 1-5 present perspective views of one embodiment of a specialized patient rotation stretcher positioned next to a cooperating patient support surface or bed, in several progressive stages of operation.

In describing preferred and alternate embodiments of the technology described herein, as illustrated in FIGS. 1-27, specific terminology is employed for the sake of clarity. The technology described herein, however, is not intended to be limited to the specific terminology so selected, and it is to be understood that each specific element includes all technical equivalents that operate in a similar manner to accomplish similar functions.

FIGS. 1-5 illustrate a patient turning accessory or specialized patient rotation stretcher 10 operable to be positioned adjacent a selected cooperating patient support surface or bed 5 for receiving a person from, or transferring a person to, the bed 5, while turning the person between the supine and prone positions. Both the patient turning accessory 10 and the cooperating patient support surface 5 are operable to tilt toward each other, as illustrated in FIGS. 2-5, to facilitate the supine-to-prone or prone-to-supine transfer.

The cooperating patient support surface or bed 5 may comprise a hospital bed, a nursing home bed, another patient care bed, a residential bed, or another patient turning accessory or stretcher 10. For example, the cooperating patient support surface or bed 5 may be a hospital bed like the bed described in PCT Application No. PCT/US2008/078118 filed on Sep. 28, 2008, and entitled "Bed with Adjustable Patient Support Framework." This application, which was published as WO 2009/048758 A1 on Apr. 16, 2009, is herein incorporated by reference in its entirety for all purposes. Preferably, the cooperating patient support surface or bed 5 is operable, like the patient turning accessory or stretcher 10 itself, to incline or tilt its patient supporting surface laterally to facilitate a supine-to-prone or prone-to-supine transfer.

The patient turning accessory or stretcher 10 comprises a wheeled transport frame or chassis 80, a patient support litter 15, and a lift mechanism 20 operable to raise one side of the patient support litter 15. In one embodiment, the patient support litter 15 comprises a mechanically-actuated mattress foundation 30 and a patient support surface or mattress 40 detachably mounted over the mattress foundation 30. In another embodiment, the patient support litter 15 comprises a sling, sheet, and/or integral mattress suspended between two poles or rods.

The patient turning accessory or stretcher 10 is distinguished, in part, by its elegant simplicity and economical and low-maintenance design. It uses a mechanically actuated patient support litter 15 or mattress foundation 30, so that it does not require inflatable pneumatic bladders to turn the patient. It also uses a minimalist collapsible frame or chassis design that reduces weight and material.

The patient support litter 15 or mattress foundation 30 has a longitudinal adjustable side 31 and an opposite longitudinal relatively fixed side 32. To turn the mattress 40 to facilitate a supine-to-prone or prone-to-supine transfer, the adjustable side 31 is raised relative to the transport frame or chassis 80, while the relatively fixed side 32 stays (approximately) in place.

Figure 2:
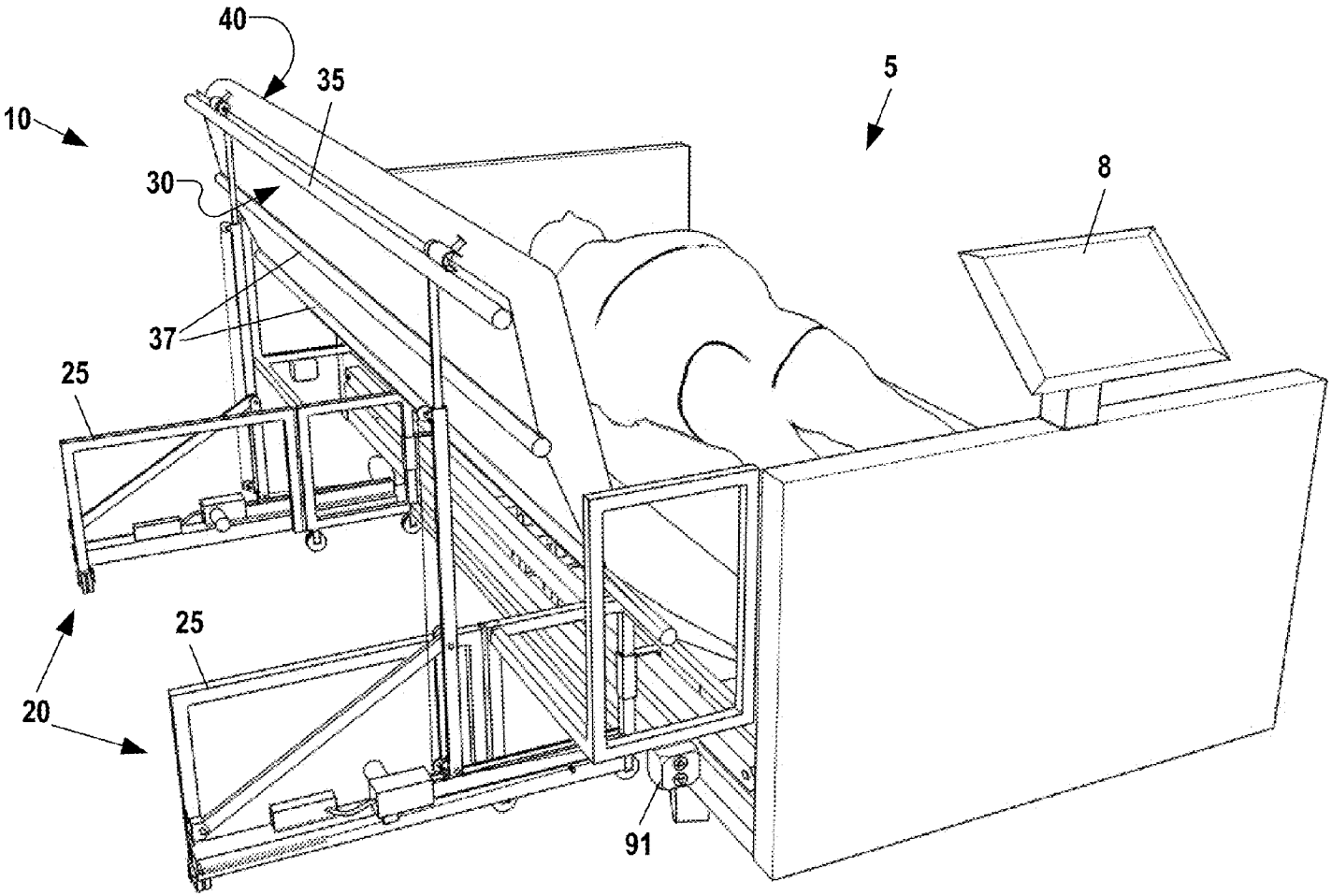
Figure 3:
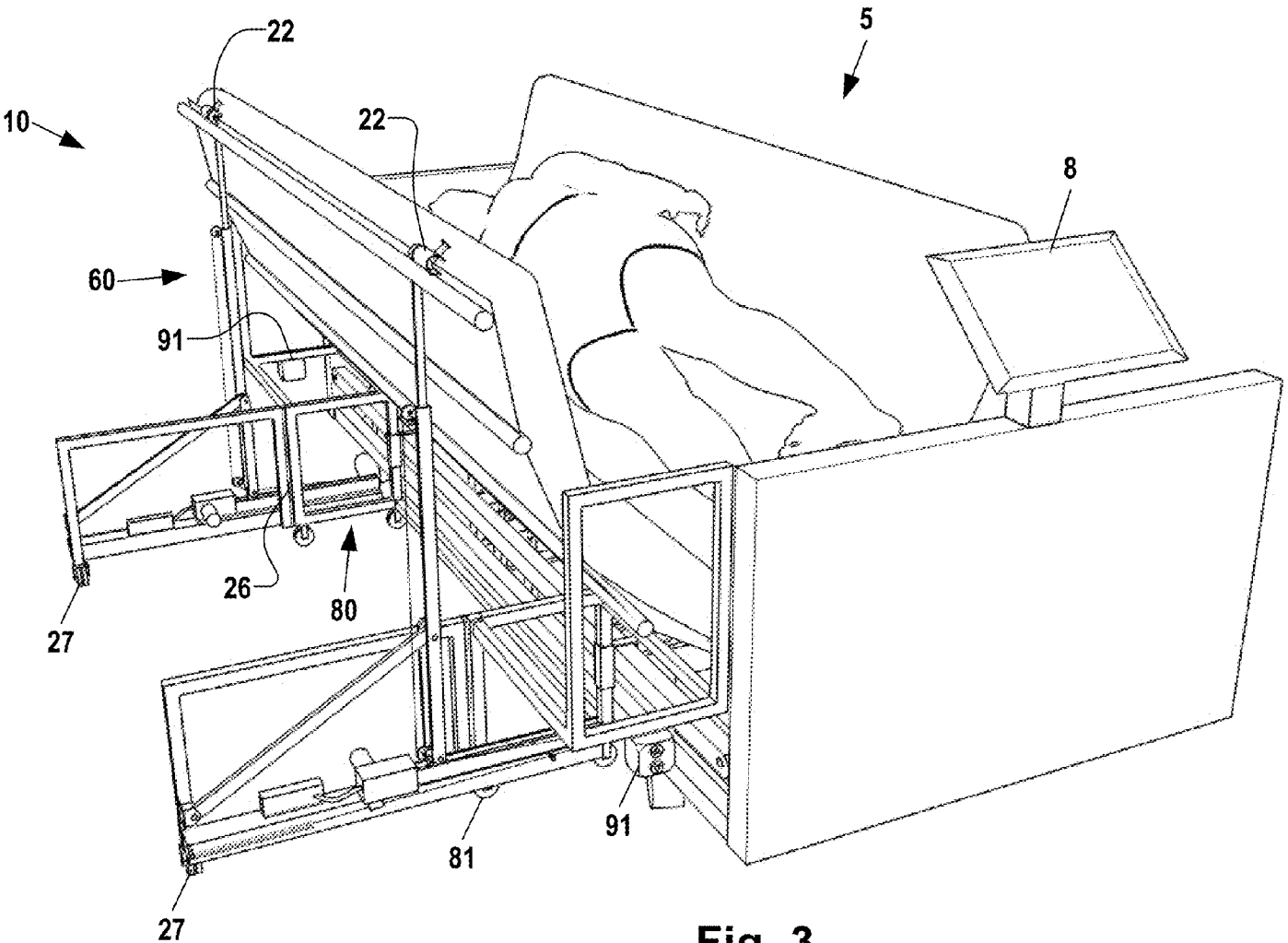
Figure 4:
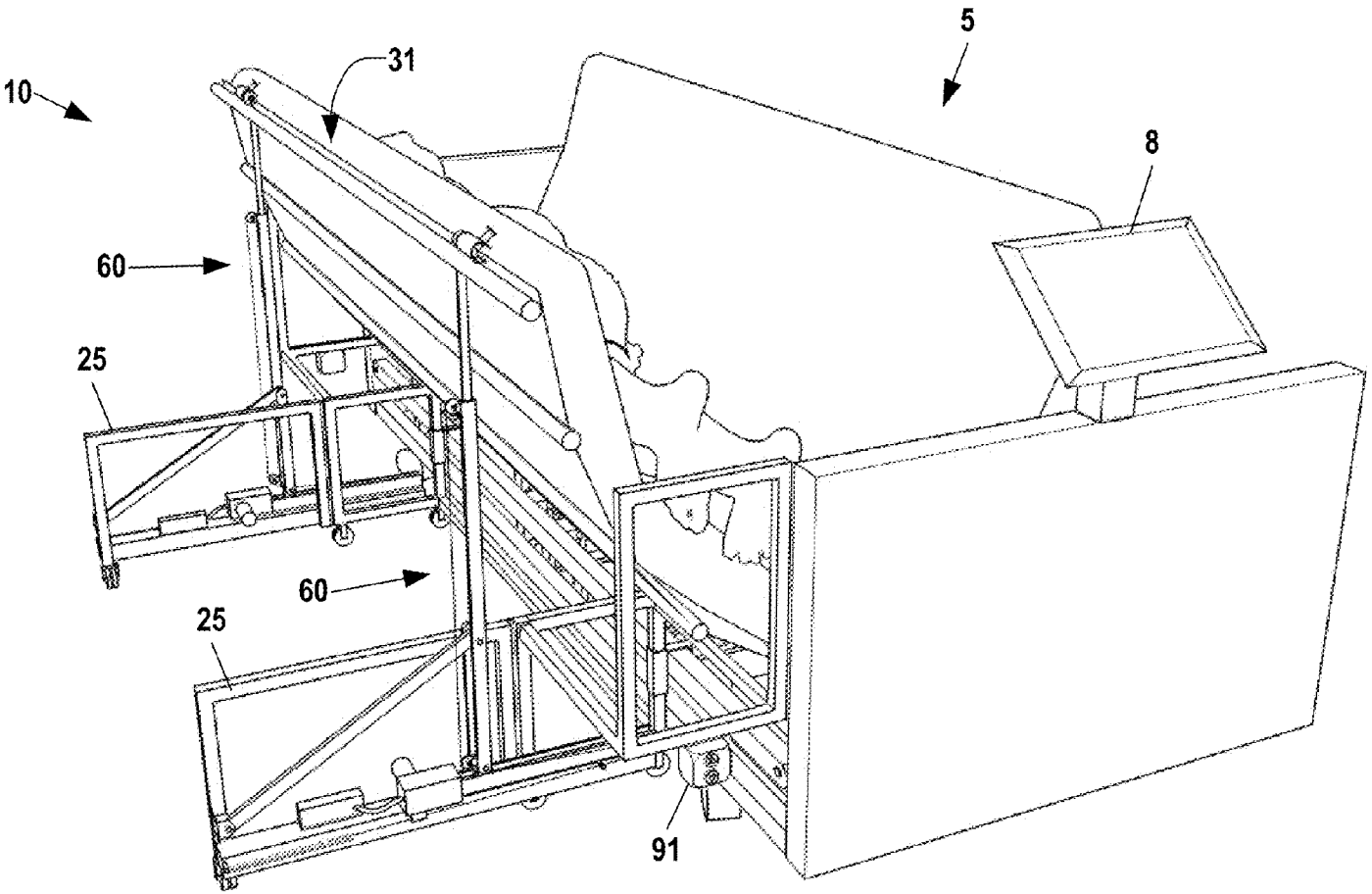
Figure 5:
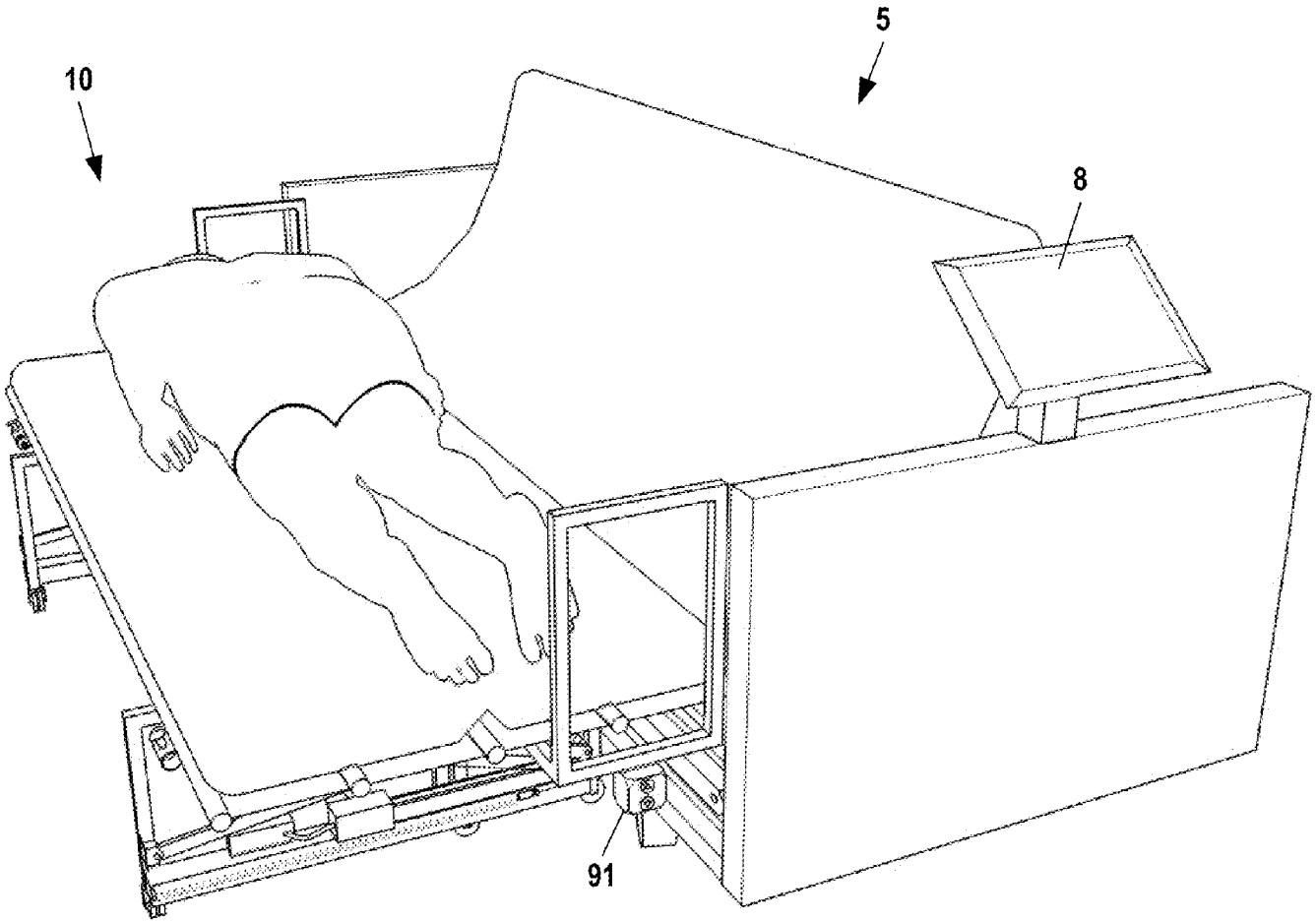

In the illustrated embodiments, the sides 31 and 32 are defined by longitudinally-oriented rigid elongate members or mattress support rods or bars. The adjustable side 31 is defined by a detachable mattress support rod or bar 35, and the relatively fixed side 32 is defined by a fixed mattress support rod or bar 36. Support rods 35 and 36 are bridged by a high-strength rectangular sheet 33 or straps, netting, or webbing material. Where a mattress 40 is included, one or more, and preferably two, intermediate longitudinally-oriented rigid elongate members or support rods 37 are optionally provided to keep the mattress foundation 30 stiff along the longitudinal dimension. As illustrated in FIGS. 2-4, the patient support litter 15, when tilted, assumes an upwardly-facing concave lateral cross-section to partially cradle a person being transferred away from or to the mattress 40.

Depending on how the patient turning accessory 10 is oriented, the patient turning accessory 10 can be positioned adjacent either a right side, or a left side, of a cooperating patient support surface 5. This is because the patient turning accessory 10 has a structure that—while asymmetric across its longitudinal midsection—is symmetric across its lateral midsection. Once the patient turning accessory 10 is wheeled into a position adjacent a cooperating patient support surface 5, the mattress 40 is operable to rotate from a substantially flat to a tilted position in only one direction.

The drawings illustrate the longitudinal adjustable side 31 of the mattress support foundation 30 on the left side (from the illustrated perspective) of the patient turning accessory 10, and the longitudinal relatively fixed side 32 on the right side. If the patient turning accessory 10 shown in FIGS. 2-5 is wheeled around the foot-end of the cooperating patient support surface 5, and turned 180°, then the sides would be reversed. The longitudinal adjustable side 31 would—from the same perspective stance illustrated in FIGS. 2-5—be on the right side and the longitudinal relatively fixed side 32 would be on the left side. In either case, the lift mechanism 20 is operable to preferentially raise the longitudinal adjustable side 31 relative to the relatively fixed side 32 of the mattress foundation 30, in order to tilt the mattress 40 toward the cooperating patient support surface 5.

The transport frame or chassis 80 comprises a longitudinal cross bar 82, a plurality of lateral stabilizing bars 83, and a plurality of vertical support bars 84. The transport frame or chassis 80 is mounted on four swiveling casters or wheels 81. The transport frame or chassis 80 is fixedly coupled (e.g., by weld) or detachably coupled to the relatively fixed mattress support rod 36 of the mattress foundation 30. Cantilevered handle subassemblies 85 are provided on both ends of the transport frame or chassis 80.

The lift mechanism 20 comprises at least one, and preferably two, mechanical actuator subassemblies 50 or 60. Each actuator subassembly 50 or 60 is mounted to a substantially rectangular, substantially planar actuator subframe 25. Each actuator subframe 25 is also mounted on a swiveling caster or wheel 27. The swiveling casters or wheels 27 and 81 on the subframe(s) 25 and transport frame or chassis 80 enable the patient turning accessory or stretcher 10 to be transported away from a bed 5 after receiving a patient from, or transferring a patient to, the bed 5.

Figure 21:
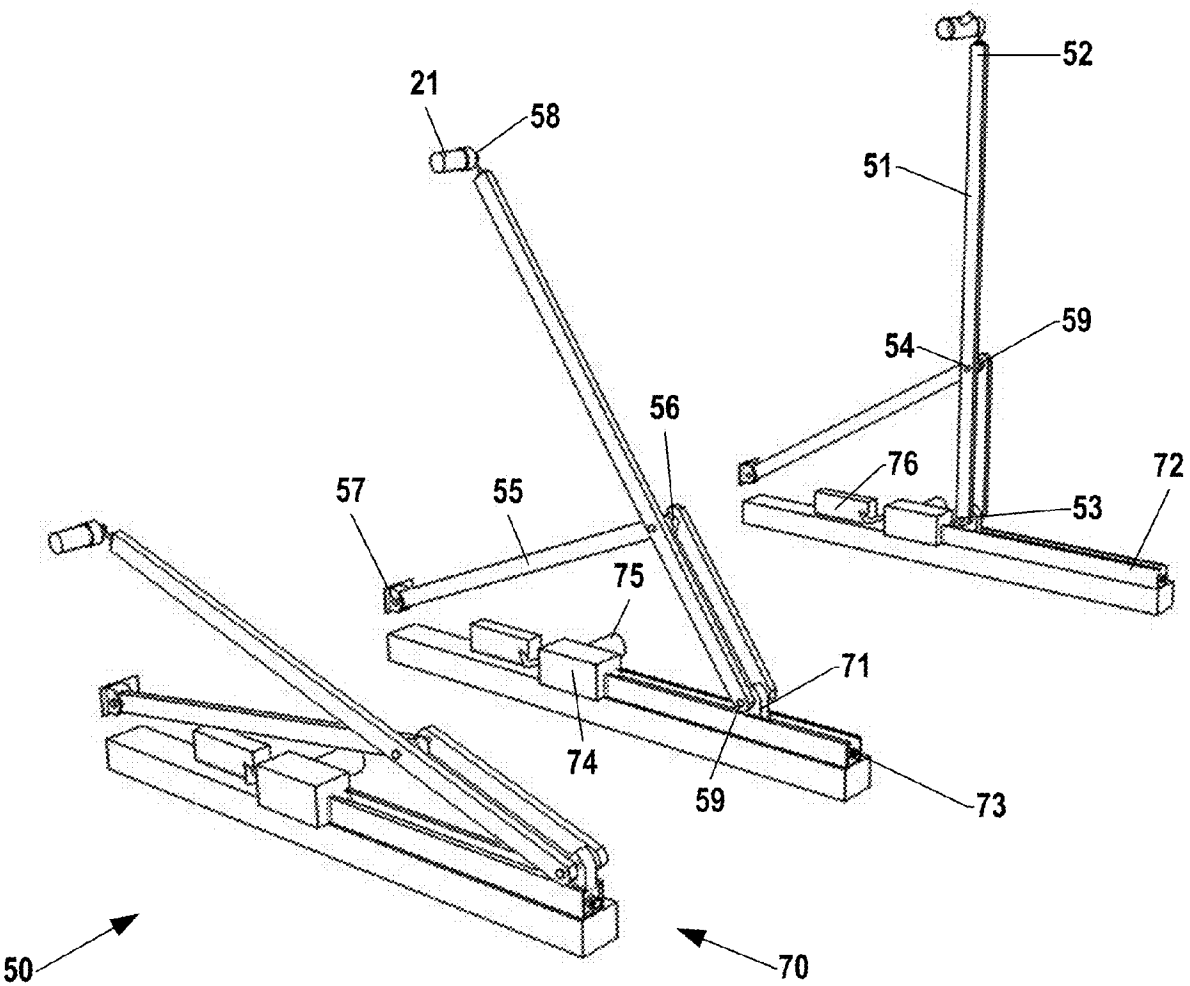
FIG. 21 is a perspective view of one embodiment of an actuator subassembly to lift the adjustable side of the patient support litter, in various ranges of motion.

FIG. 21 illustrates one embodiment of an actuator subassembly 50. The actuator subassembly 50 comprises a mechanical lateral actuator 70 drivingly connected to a principal arm 51. The mechanical lateral actuator 70 comprises a sliding element 71 movable within a sliding guide 72. The inferior (i.e., lower) end 53 of the principal arm 51 is connected to the sliding element 71 via a hinge 59. The superior (i.e., upper) end 52 of the principal arm 51 is connected to the pivotal joint 58.

A secondary arm 55, having superior and inferior ends 56 and 57, respectively, provides support to the principal arm 51. The superior end 56 of the secondary arm 55 is connected a midsection 54 of the principal arm 51 via a hinge 59. The inferior end 57 of the secondary arm 55 is attached to the actuator subframe 25 via another hinge 59. A screw 73 driven by an electric motor 75 and a mechanical reducer 74 advances or retreats the sliding element 71 within the sliding guide 72. A peripheral control unit 76 connected to motor 75 via cable operates the motor 75.

Figure 22:
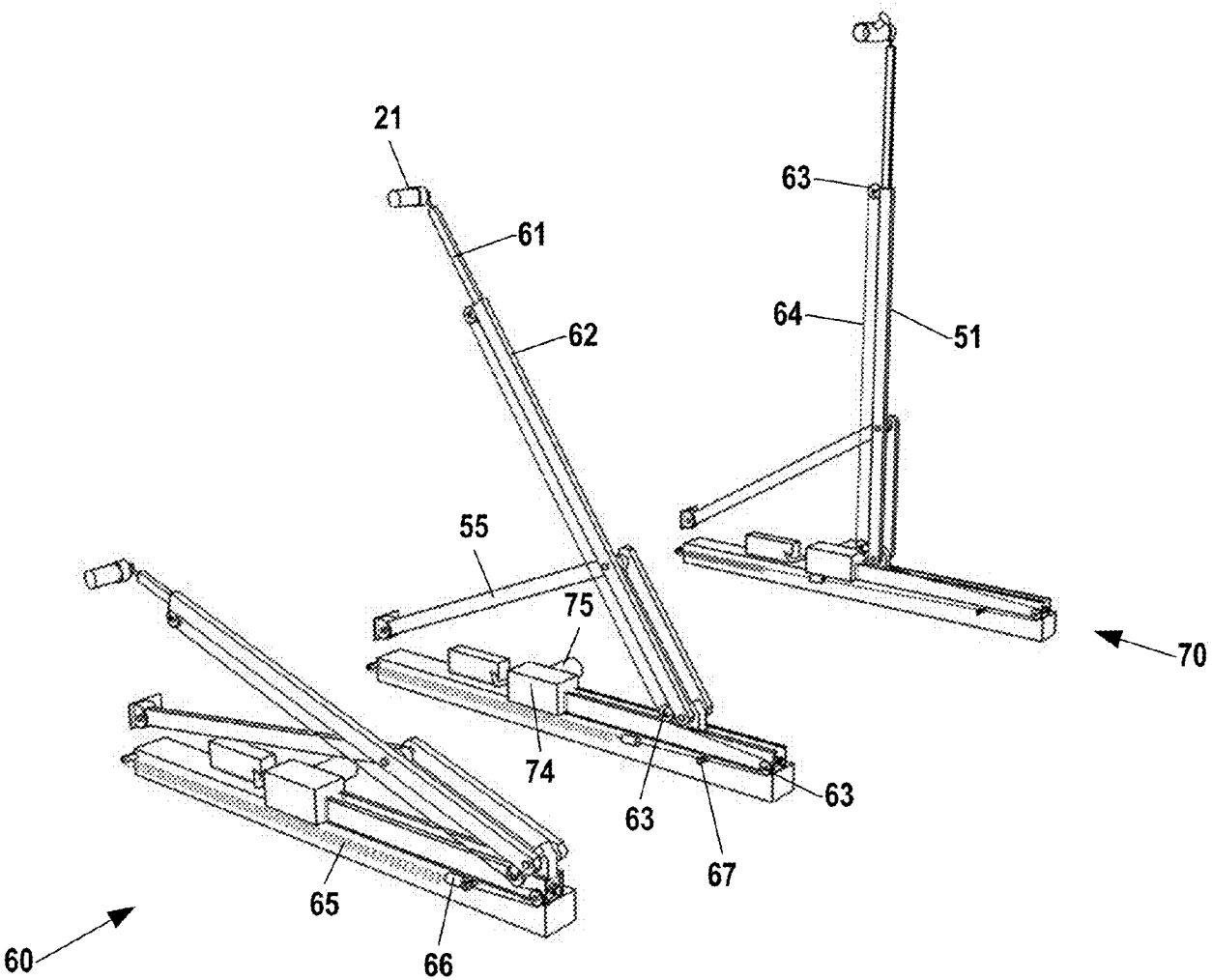
FIG. 22 is a perspective view of another embodiment of an actuator subassembly, incorporating a telescopic arm operated by a spring and steel cord, to lift the adjustable side of the patient support litter, again in various ranges of motion.

FIG. 22 illustrates another actuator subassembly 60. This alternative assembly closely resembles the embodiment of FIG. 21, but the principal arm 51 includes an inner rod 61 that telescopes within a coaxial outer rod 62. A steel cord 64 mounted on several pulleys 63, and tensioned by a spring 65, drives the sliding action of the telescoping inner rod 61. One end of the steel cord 64 is connected to the telescoping inner rod 61. The opposite end of the steel cord 64 is connected to the spring 65. Operation of the mechanical lateral actuator 70 to raise the principal arm 51 increases the tension on the steel cord 64. This causes the spring 65 to stretch and the telescoping inner rod 61 to extend.

Figure 23:
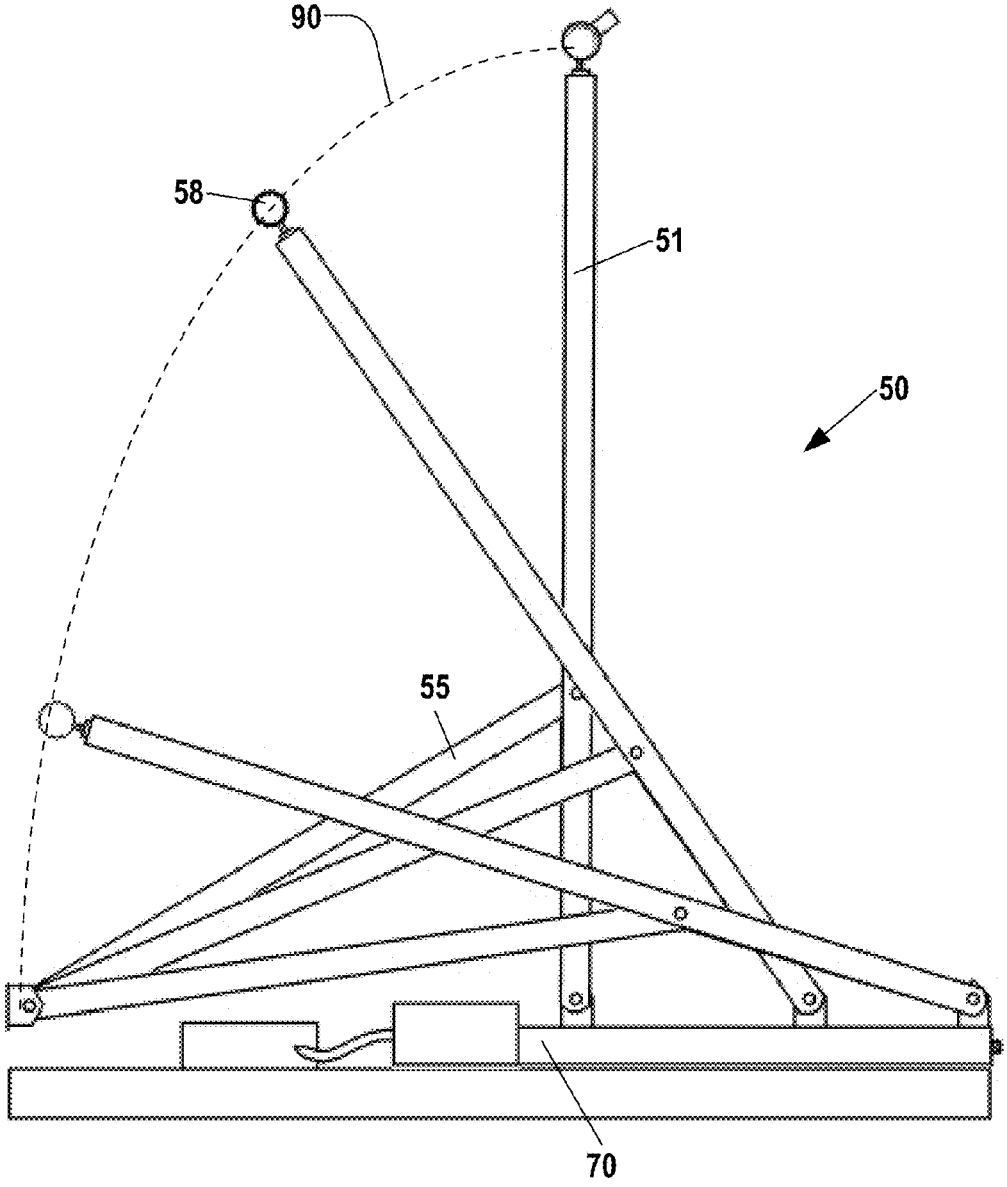
FIG. 23 superimposes three side views of the actuator subassembly of FIG. 21, illustrating the characteristic trajectory or arc about which the actuator subassembly lifts the adjustable side of the patient support litter.
Figure 24:
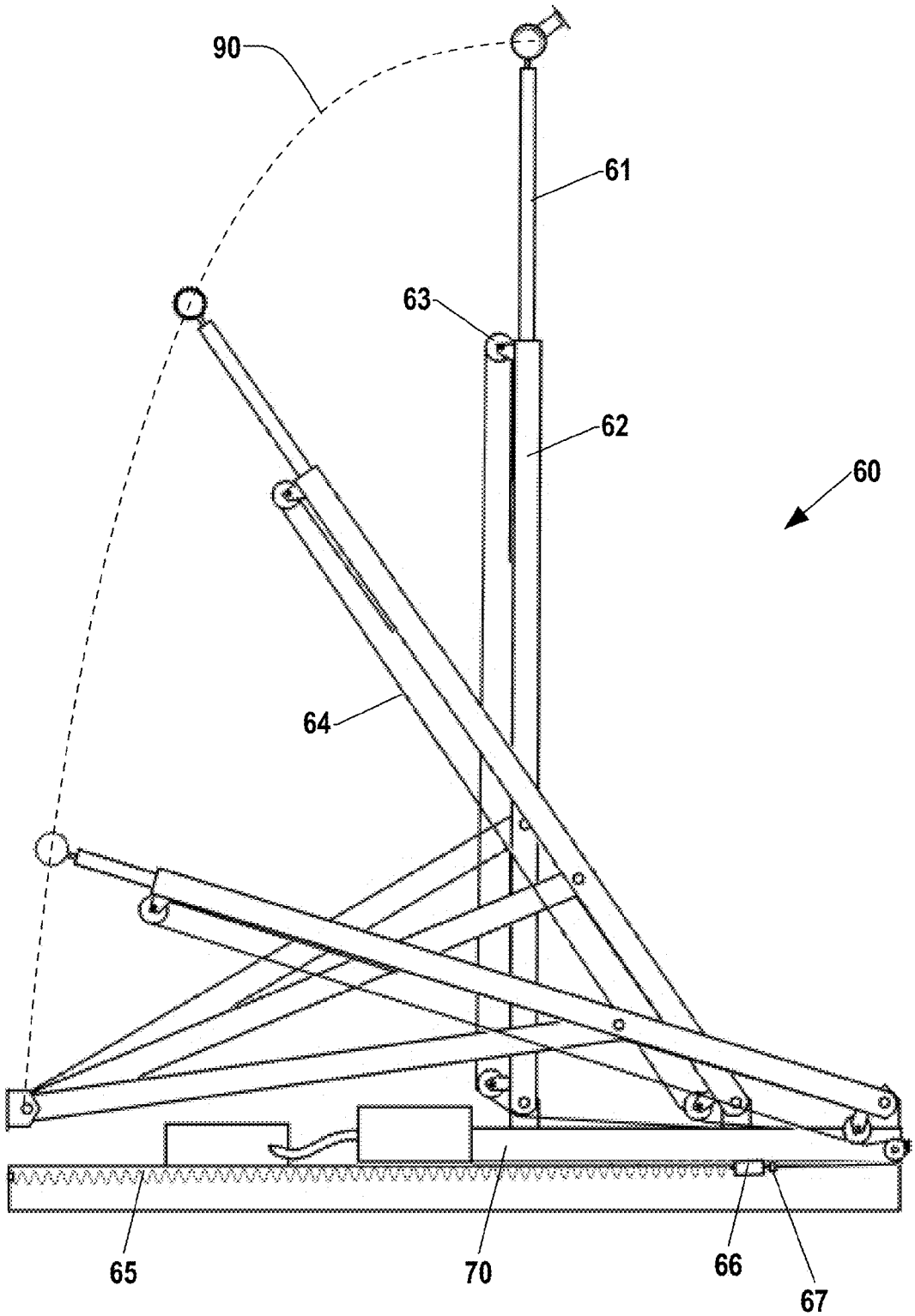
FIG. 24 superimposes three side views of the actuator subassembly of FIG. 22, illustrating the characteristic trajectory about which the actuator subassembly lifts the adjustable side of the patient support litter.

FIGS. 23 and 24 illustrate the range of travel of the actuator subassemblies 50 and 60. Operation of the mechanical lateral actuator 70 causes the respective pivotal joint 58 to travel along a characteristic path or trajectory 90. This characteristic path or trajectory 90—which more closely approximates a semi-parabolic arc than a semi-circular arc—is defined, in part, by the position of hinge 59 joining the secondary arm 55 to the principal arm 51. The approximately semi-parabolic trajectory yields more vertical than lateral displacement, and is better suited to rotating the patient than a semi-circular trajectory would be.

The actuator subassembly 60 provides further structure to regulate the characteristic path or trajectory 90 about which the respective pivotal joint 58 moves. A register 66 is secured to the steel cord 64, and the steel cord 64 is threaded through a mechanical limit 67. When the register 66 meets the mechanical limit 67, further operation of the mechanical lateral actuator 70 to raise the principal arm 51 causes the steel cord 64 to exert traction action on the telescoping inner rod 61, thereby raising it. As the principal arm 51 is lowered, tension on the spring 65 is relieved, and the telescoping inner rod 61 retracts back into the coaxial outer rod 62. The position of the register 66 can be changed to adjust the desired characteristic path or trajectory 90.

In other embodiments, the actuators utilize alternative actuator structures disclosed in FIGS. 11-18 of our PCT Application No. PCT/US2008/078118, which are herein incorporated by reference.

FIGS. 8-19 illustrate how the patient turning accessory or stretcher 10 is collapsible into a compact storage configuration.

The mattress 40—which comprises latex or polyurethane foam sections or cushions enclosed within a breathable, hydrophobic cover—is a sectional mattress collapsible along one or more longitudinal fold lines 41 for folding the mattress 40 into a compact storage configuration. FIGS. 9-12 illustrate the mattress 40 folded over itself, along its longitudinal center, in a compact storage configuration.

Figure 12:
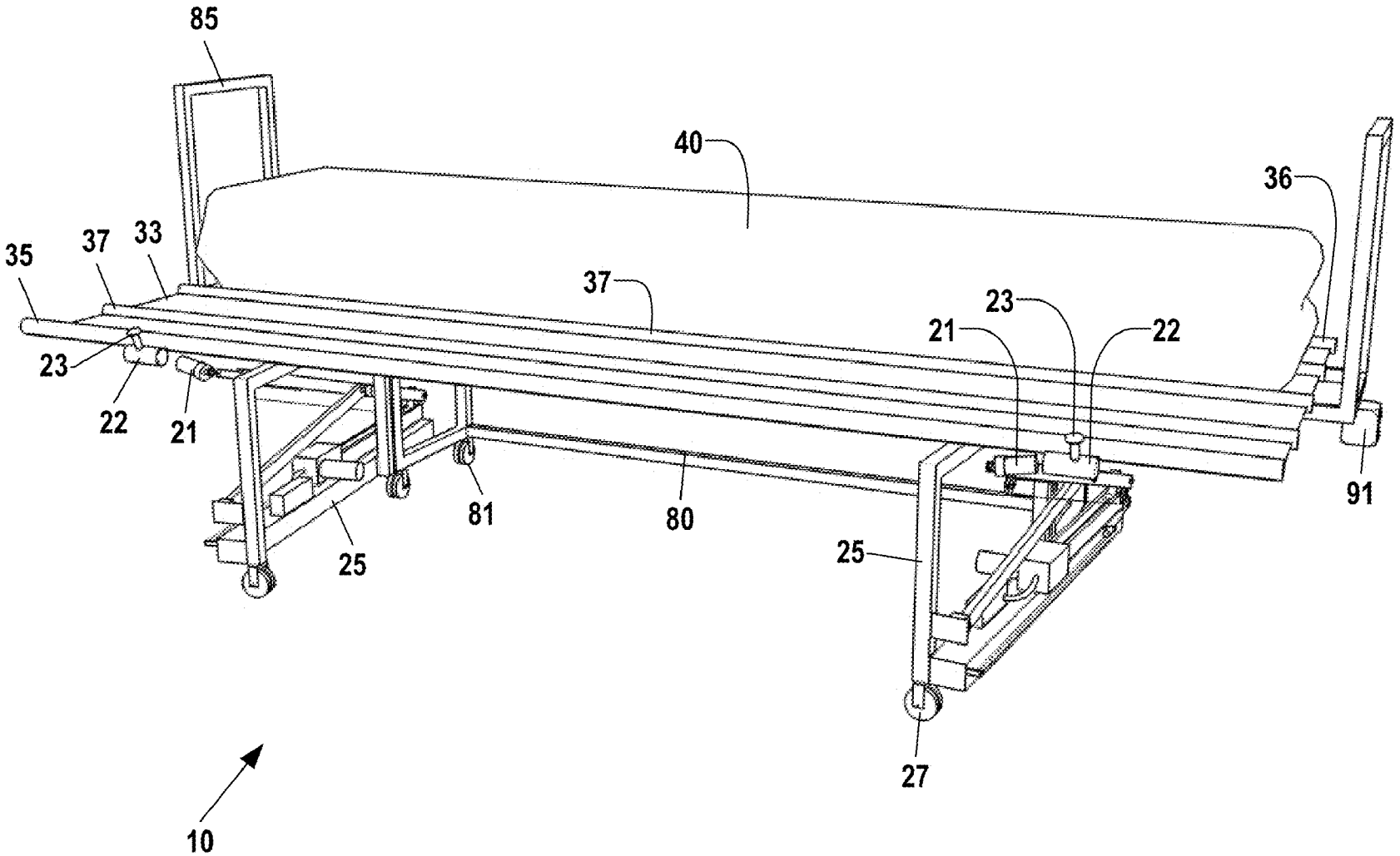
Figure 13:
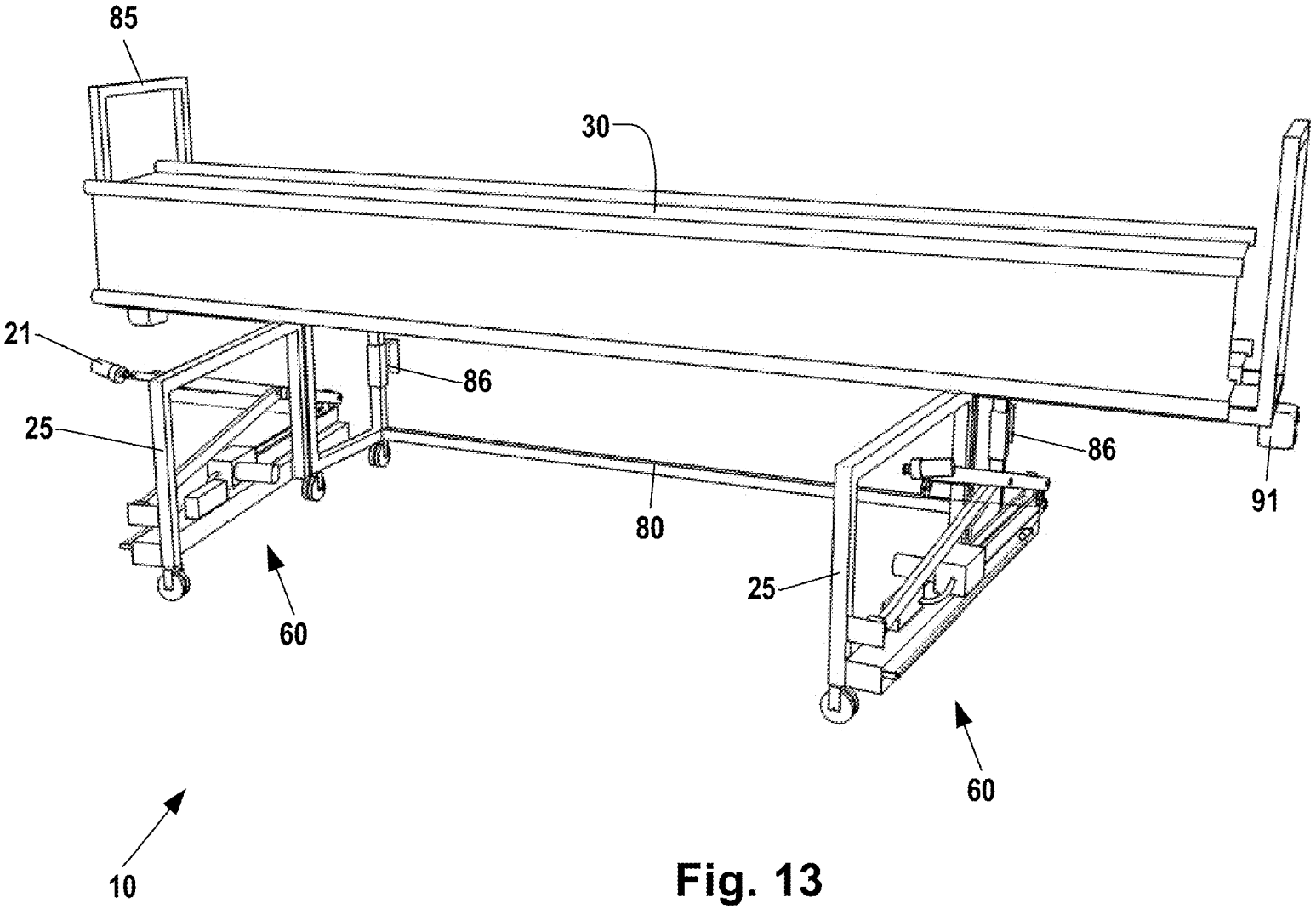
FIGS. 13 and 14 illustrate a mattress support foundation of the patient support litter being folded over the folded sectional mattress, into a compact storage configuration.
Figure 14:
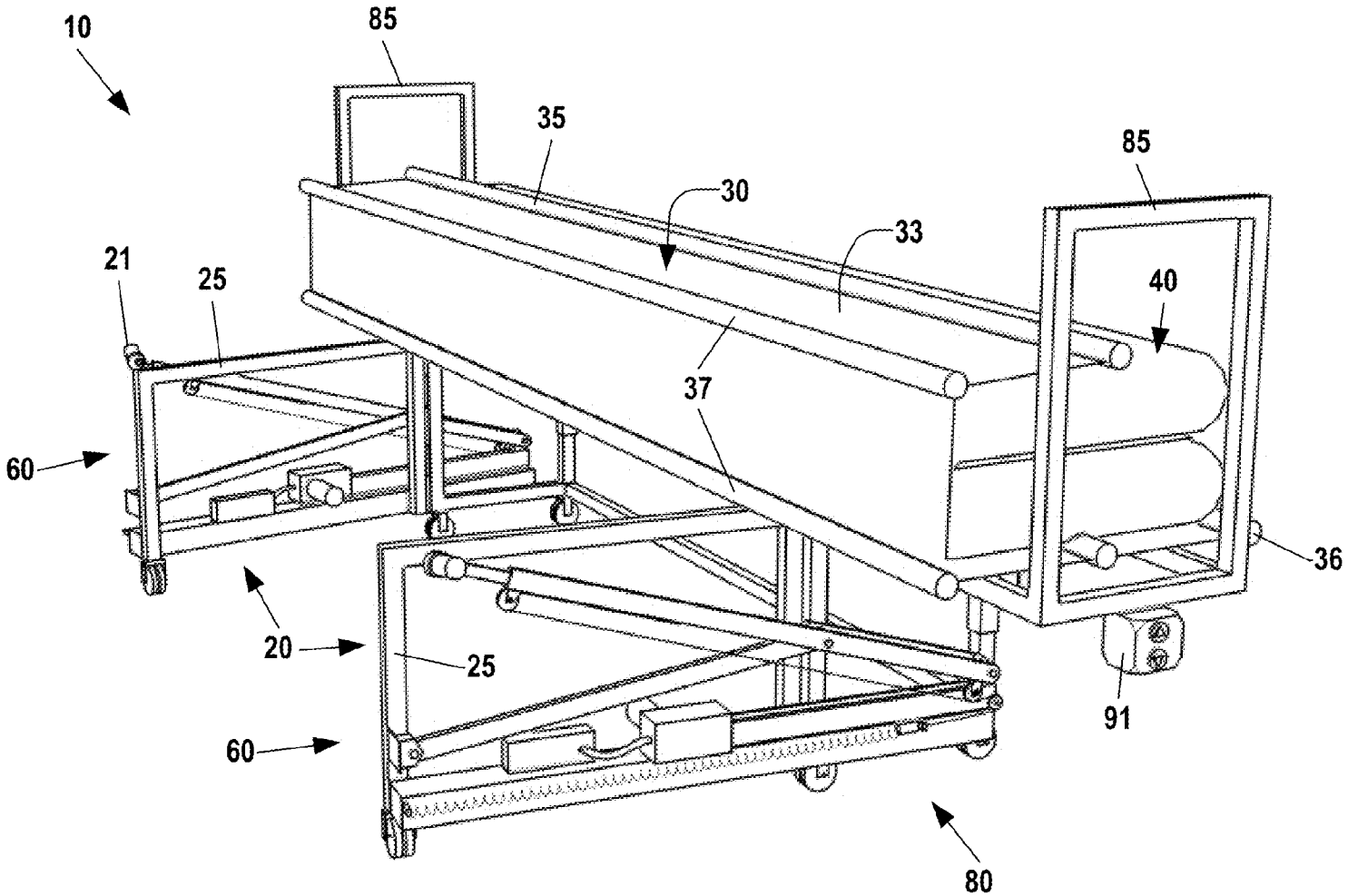
Figure 15:
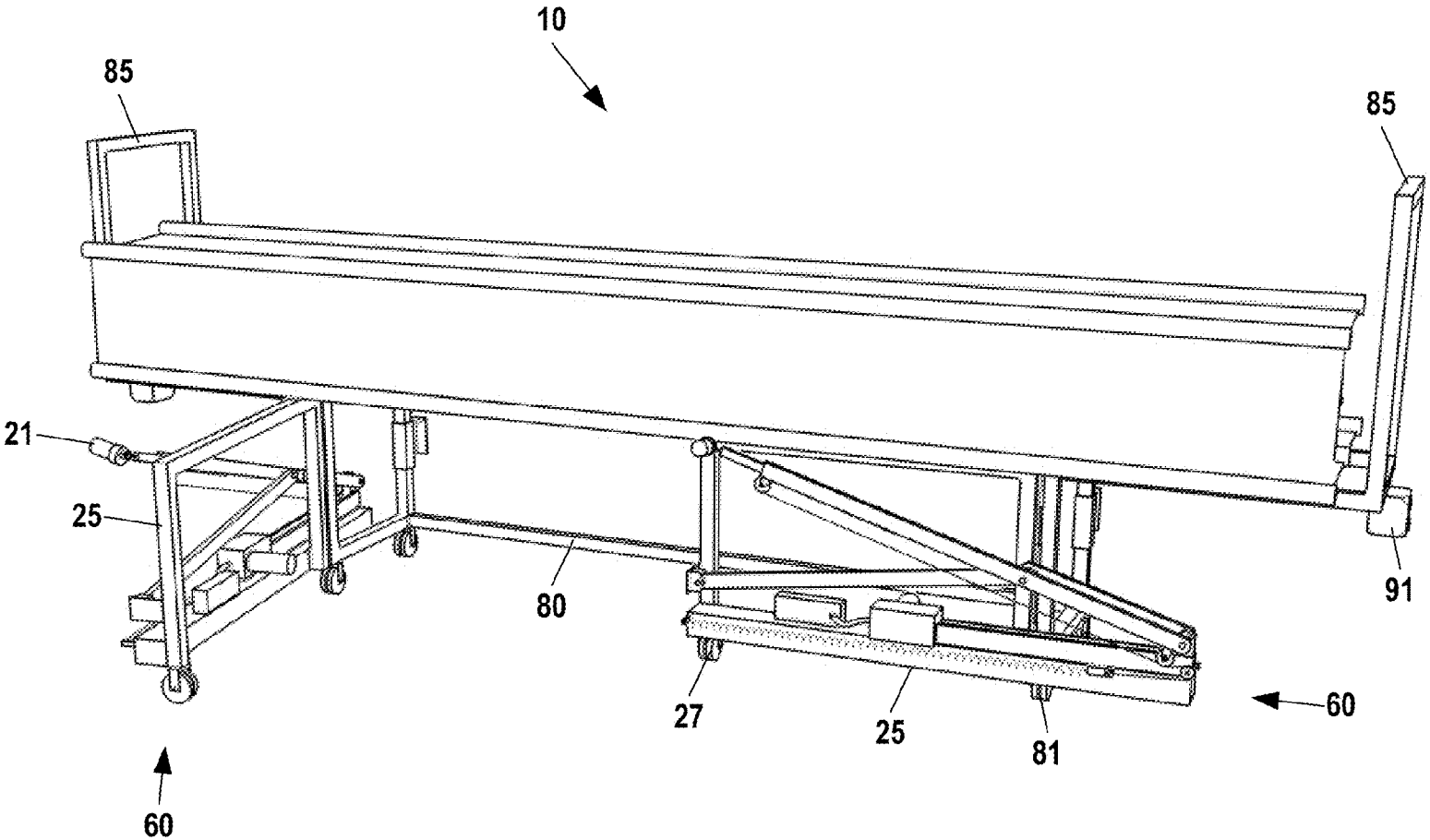
FIGS. 15 and 16 illustrate one of the actuator subframes of the specialized patient rotation stretcher of FIGS. 1-5 folded from its previously outwardly extended operational position, which is laterally oriented with respect to the transport frame, to a retracted storage position.
Figure 16:
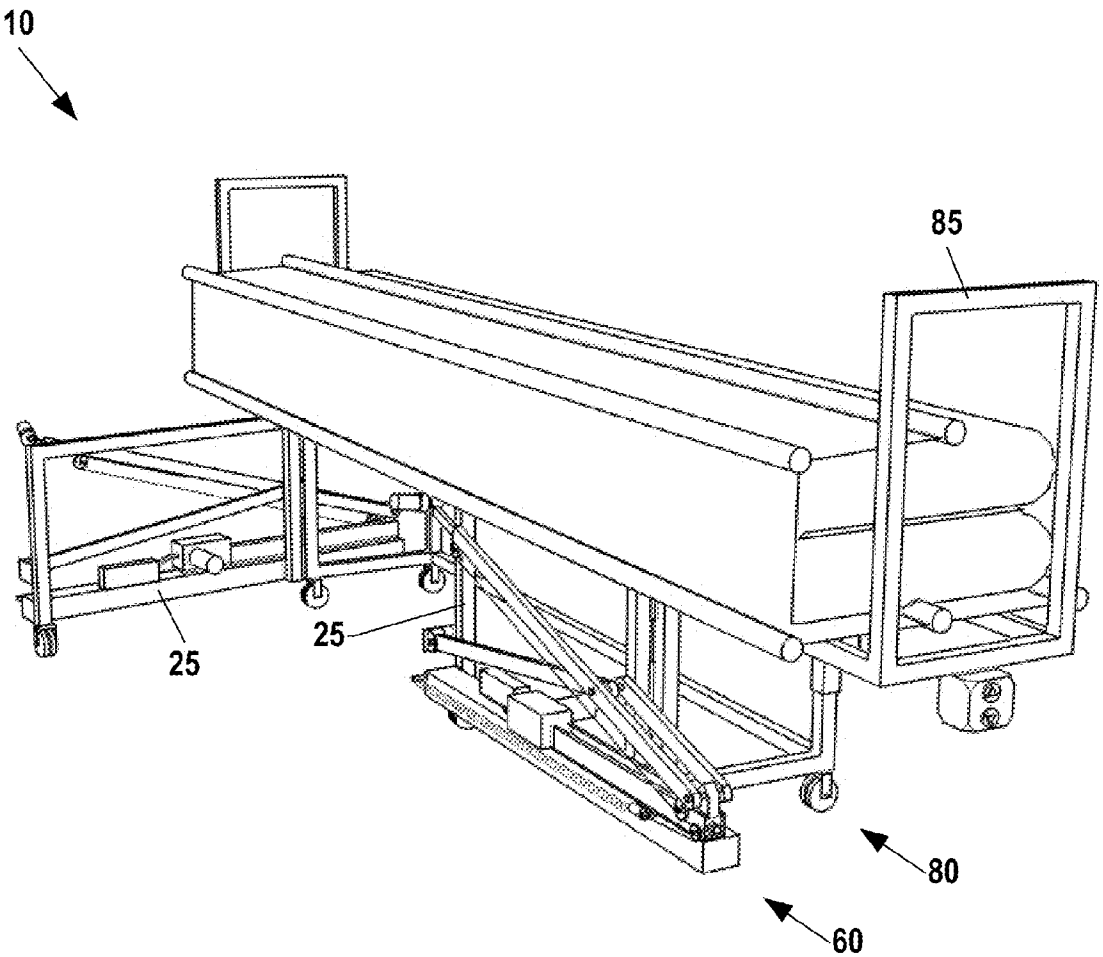
Figure 17:
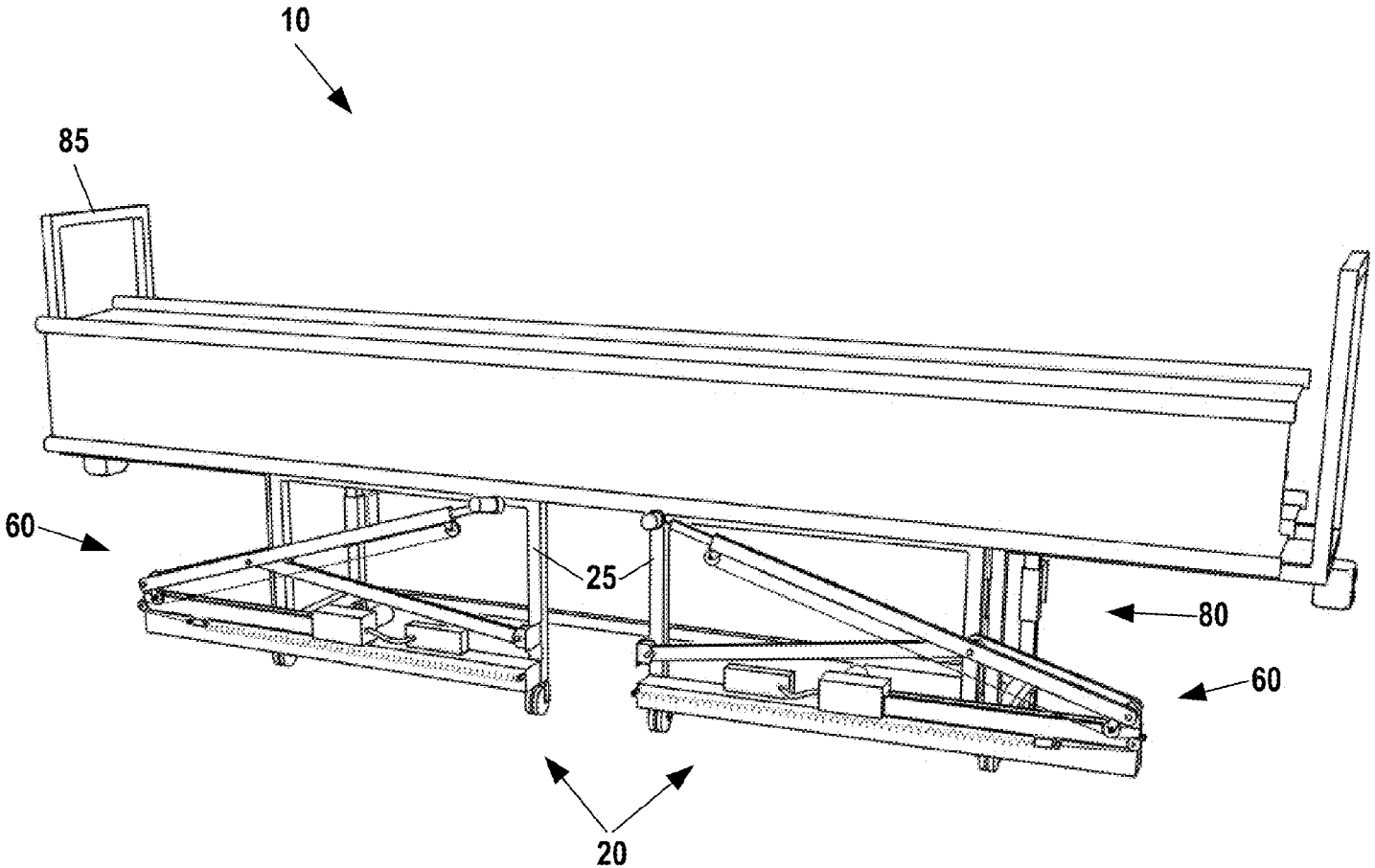
FIGS. 17-19 illustrate both actuator subframes folded into their retracted storage positions.
Figure 18:
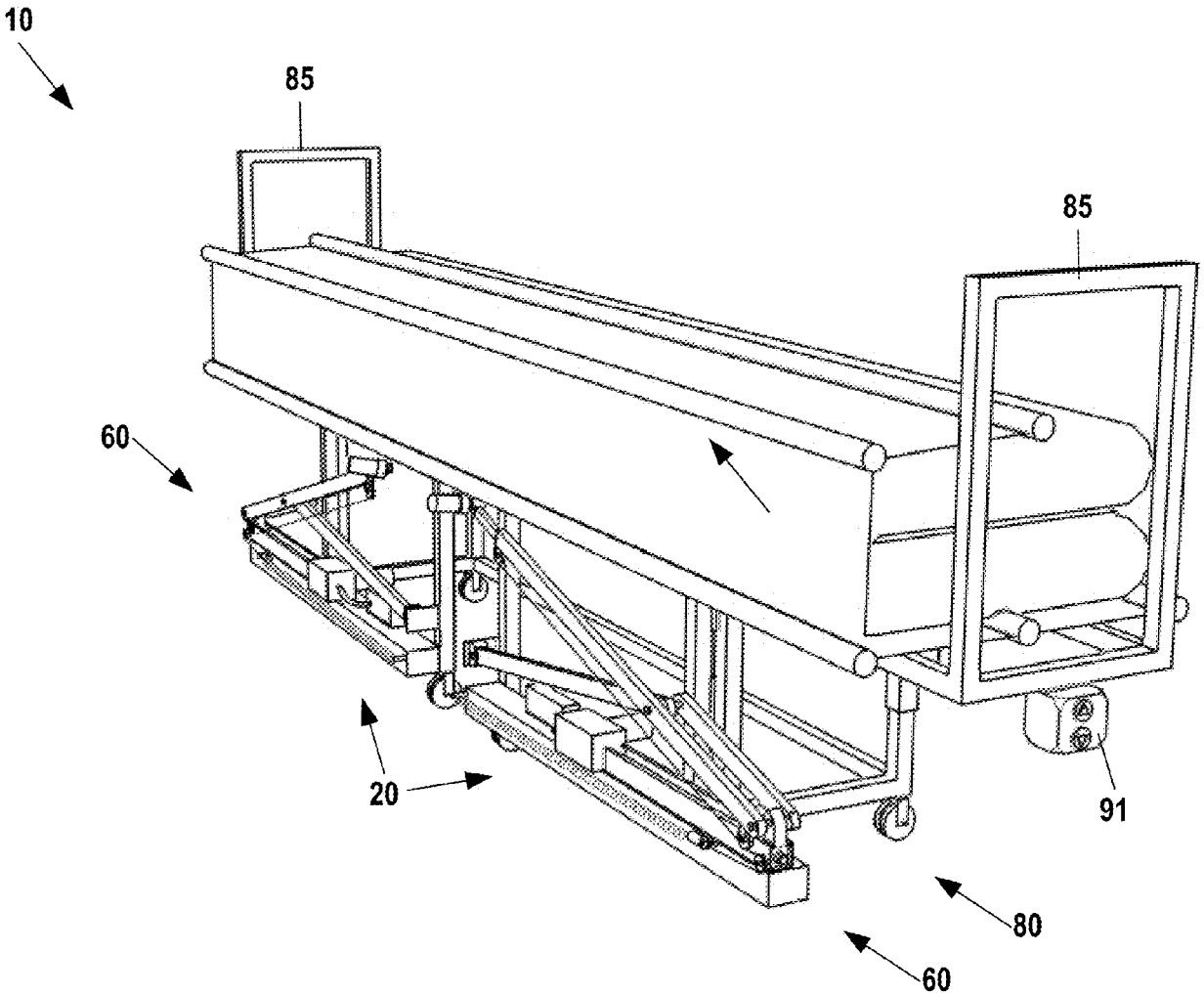
Figure 19:
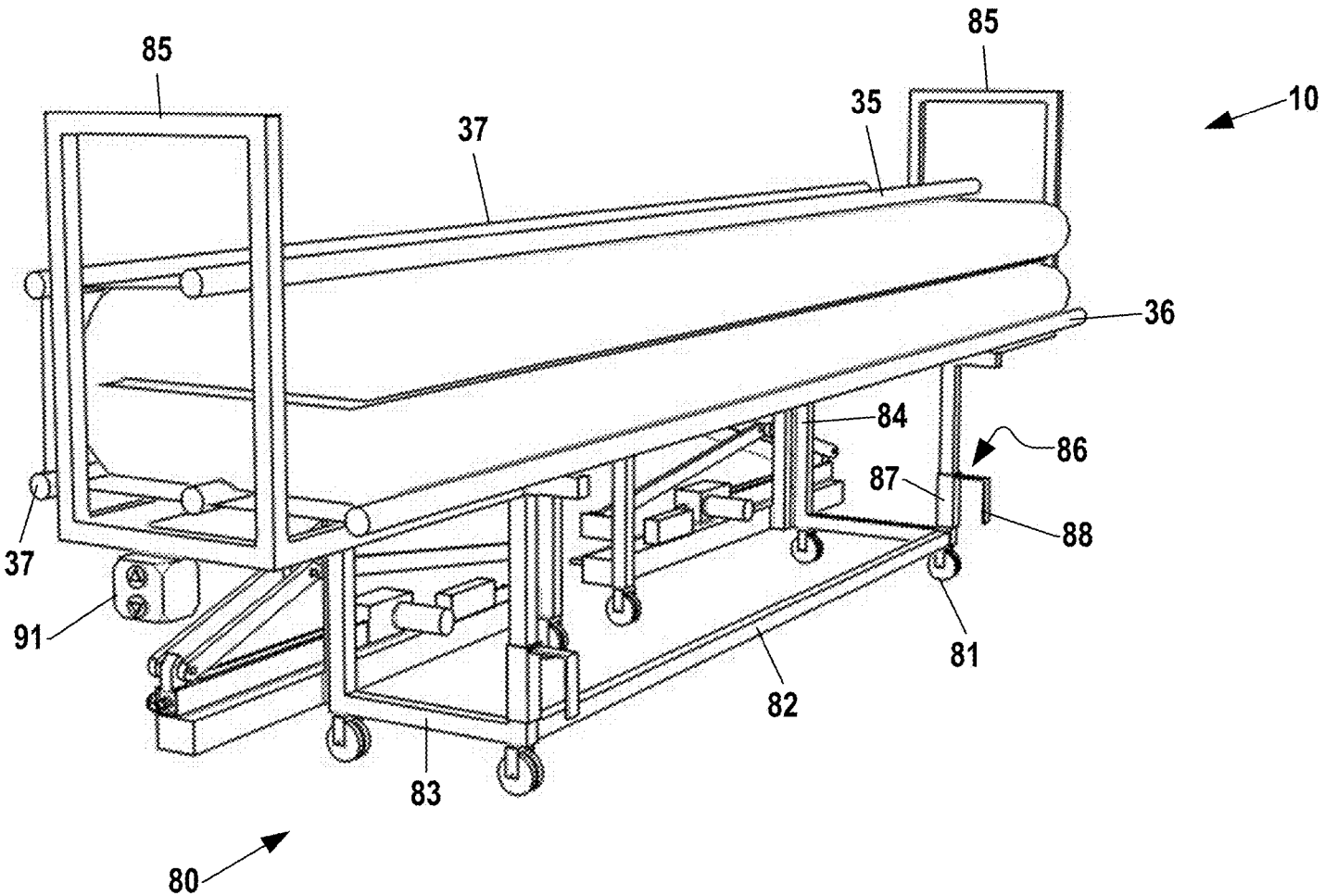
Figure 20:
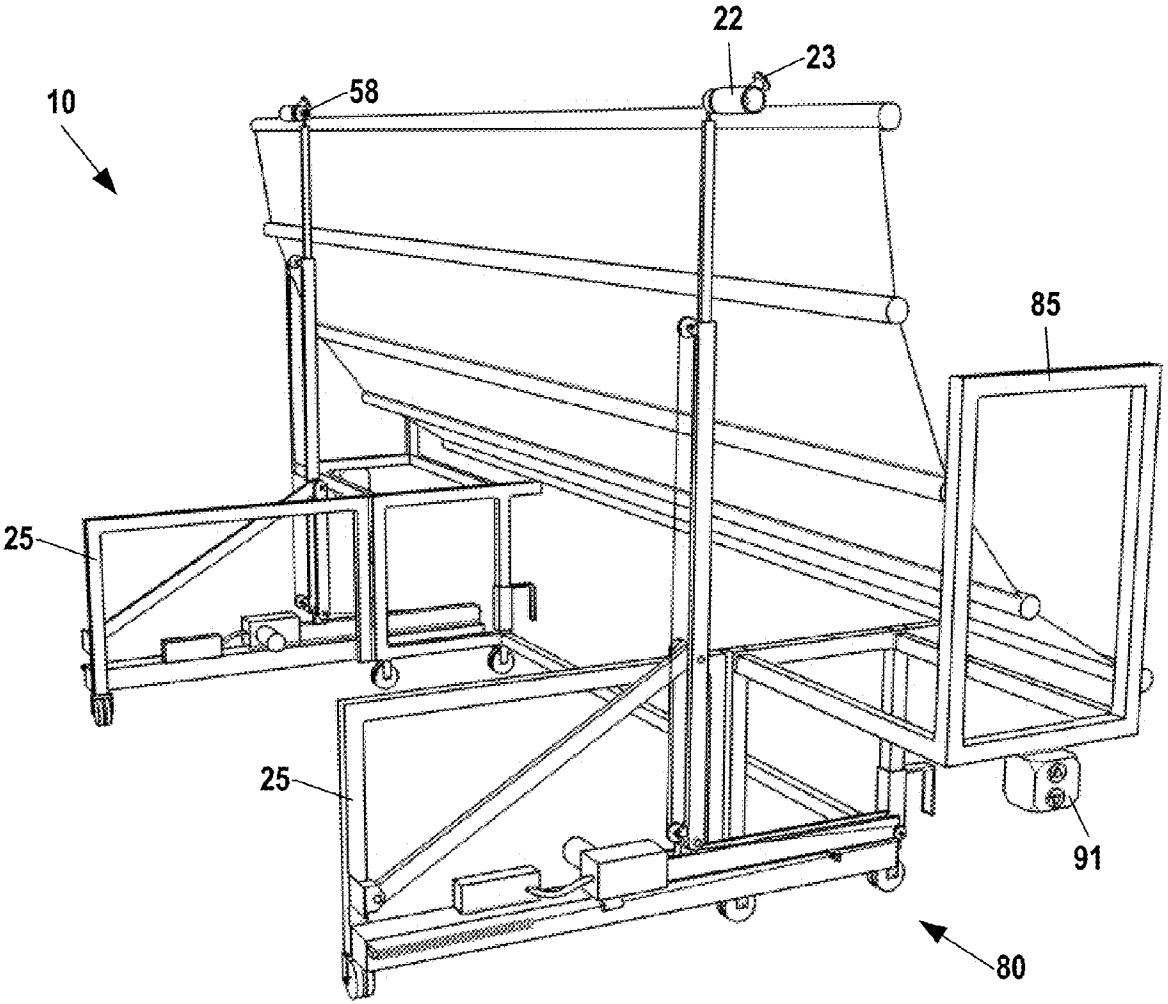
FIG. 20 is a perspective view of the specialized patient rotation stretcher, without an overlying sectional mattress, in a fully tilted position.

FIGS. 12-14 illustrate how the detachable mattress support rod or bar 35 of the mattress foundation 30 is operable to be attached to, or detached from, the lift mechanism 20. One or more couplers are provided to pivotally and detachably couple the lift mechanism 20 to the adjustable side 31 of the mattress foundation 30. In one embodiment, the couplers comprise cooperating pairs of male and female coupling members 21 and 22. On each actuator subassembly 50 or 60, a male coupling member 21 is attached to a pivotal joint 58 on the superior end 52 of the principal arm 51. A cooperating female coupling member 22—such as a socket, sleeve, or clip—is affixed (preferably via weld) to the detachable mattress support rod 35. (The female coupling members 22 are omitted from view on FIGS. 13-19).

To attach the lift mechanism 20 to the adjustable side 31 of the mattress foundation 30, each male coupling member 21 is inserted into its corresponding female coupling member 22. Then for each coupler, a retainer 23, such as a thumb screw or a clamp, is operated to lock the male coupling member 21 in place. To detach the adjustable side 31 of the mattress foundation 30 from the lift mechanism 20, the retainer 23 on each coupler is operated to release its grip on the male coupling member 21, and the male coupling members 21 are removed from the female coupling members 22.

It will be appreciated that other coupling embodiments, such as a pair of resilient clips, would also be suitable for detachably coupling the lift mechanism 20 to the adjustable side 32 of the mattress foundation 30.

After the adjustable side 31 of the mattress foundation 30 is detached from the lift mechanism 20, the mattress foundation 30 can then be folded over the mattress 40, when the mattress 40 is folded into a compact storage configuration, to collapse the patient turning accessory 10 into a compact storage configuration.

FIGS. 15-19 illustrate how the lift mechanism 20 itself is collapsible from an extended operating position to a compact storage configuration. Each actuator subframe 25 is mounted to the transport frame or chassis 80 for movement between an outwardly extended operational position and a retracted storage position. More particularly, each actuator subframe 25 is operable to be pivoted via hinges 26 (mostly concealed from view) about a vertical axis between the outwardly extended operational position, which is laterally oriented with respect to the transport frame 80, and the retracted storage position.

It will be noted when being pivoted into its outwardly extended operational position, each actuator subframe 25 acts as an extension of the transport frame or chassis 80, forming an integral part of the structural support of the mattress foundation 30 and mattress 40 of the patient turning accessory or stretcher 20. Also, each actuator subassembly 50 or 60 includes a section that travels underneath the cantilevered handle subassemblies 85 of the transport frame or chassis 80.

The patient turning accessory or stretcher 10 also includes anchor means for securing the patient turning accessory to a position adjacent the cooperating patient support surface or bed 5. The anchor means may comprise stop means for resisting movement of the patient turning accessory or stretcher 10 relative to the floor, or it may comprise coupling means for coupling the patient turning accessory or stretcher 10 to an adjoining patient support surface or bed 5.

Examples of stop means include one or more brakes on the swiveling casters or wheels 27 and/or 81, a shoe that can be lowered from the transport frame or chassis 80 onto the floor, or any other suitable structure for resisting lateral translation of the patient turning accessory or stretcher 10.

Examples of coupling means include any suitable connector for connecting or temporarily attaching the patient turning accessory or stretcher 10 to an adjoining patient support surface or bed 5. The connector may comprise one or more brackets, screws, clips, male and female couplers, or locks.

Figure 6:
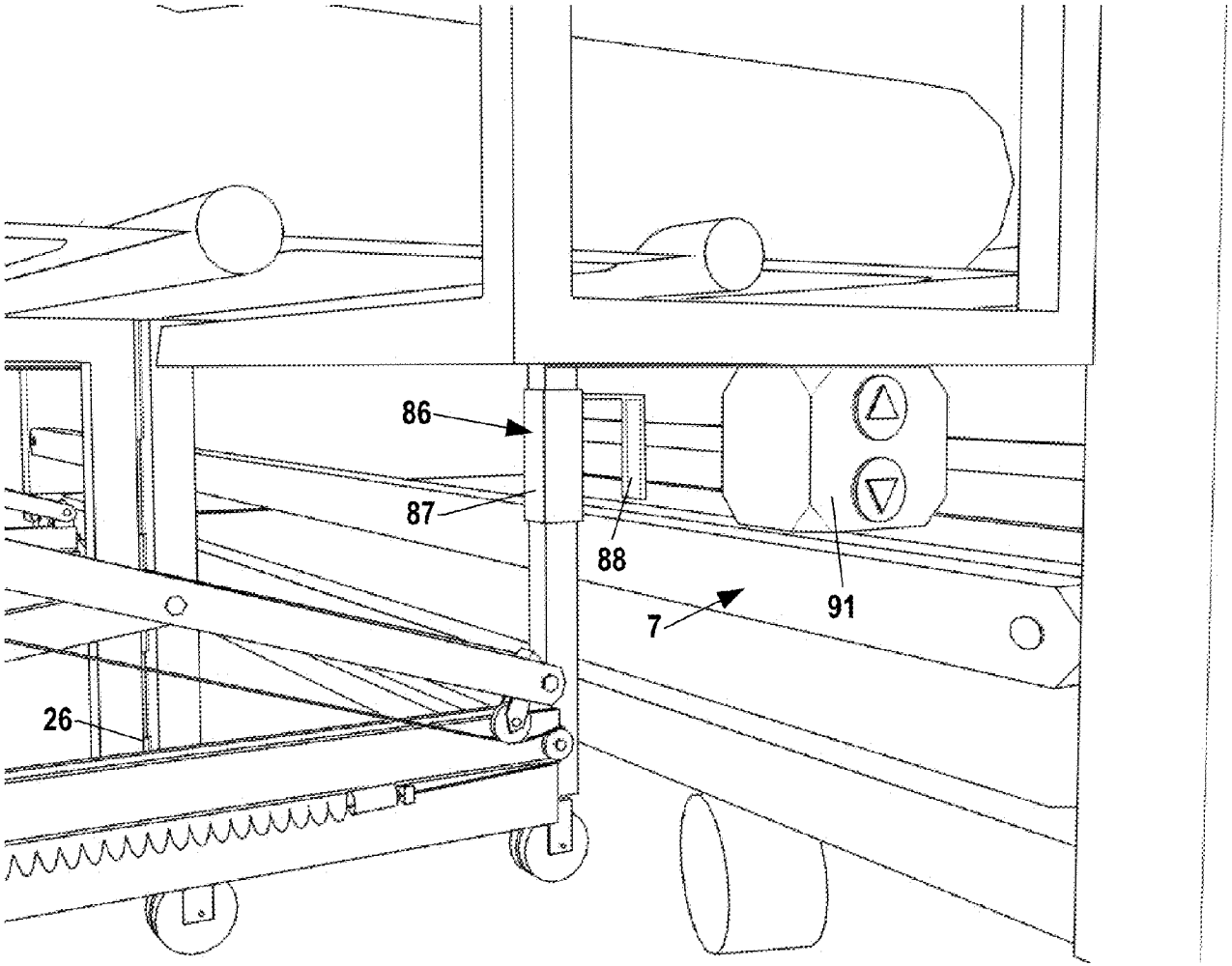
FIGS. 6 and 7 illustrate one embodiment of a connector for releasably coupling the specialized patient rotation stretcher to a cooperating patient support surface or bed.
Figure 7:
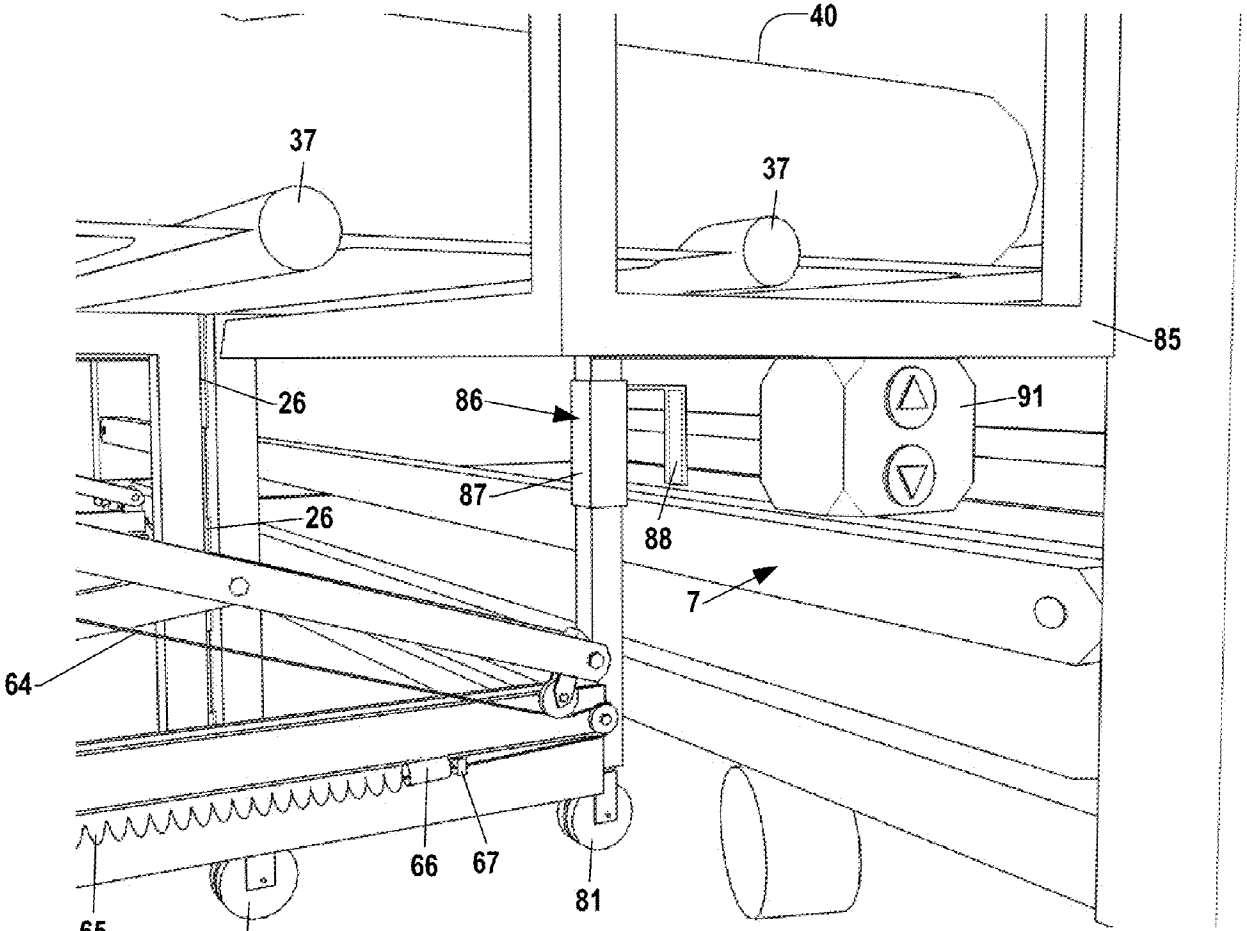
Figure 8:
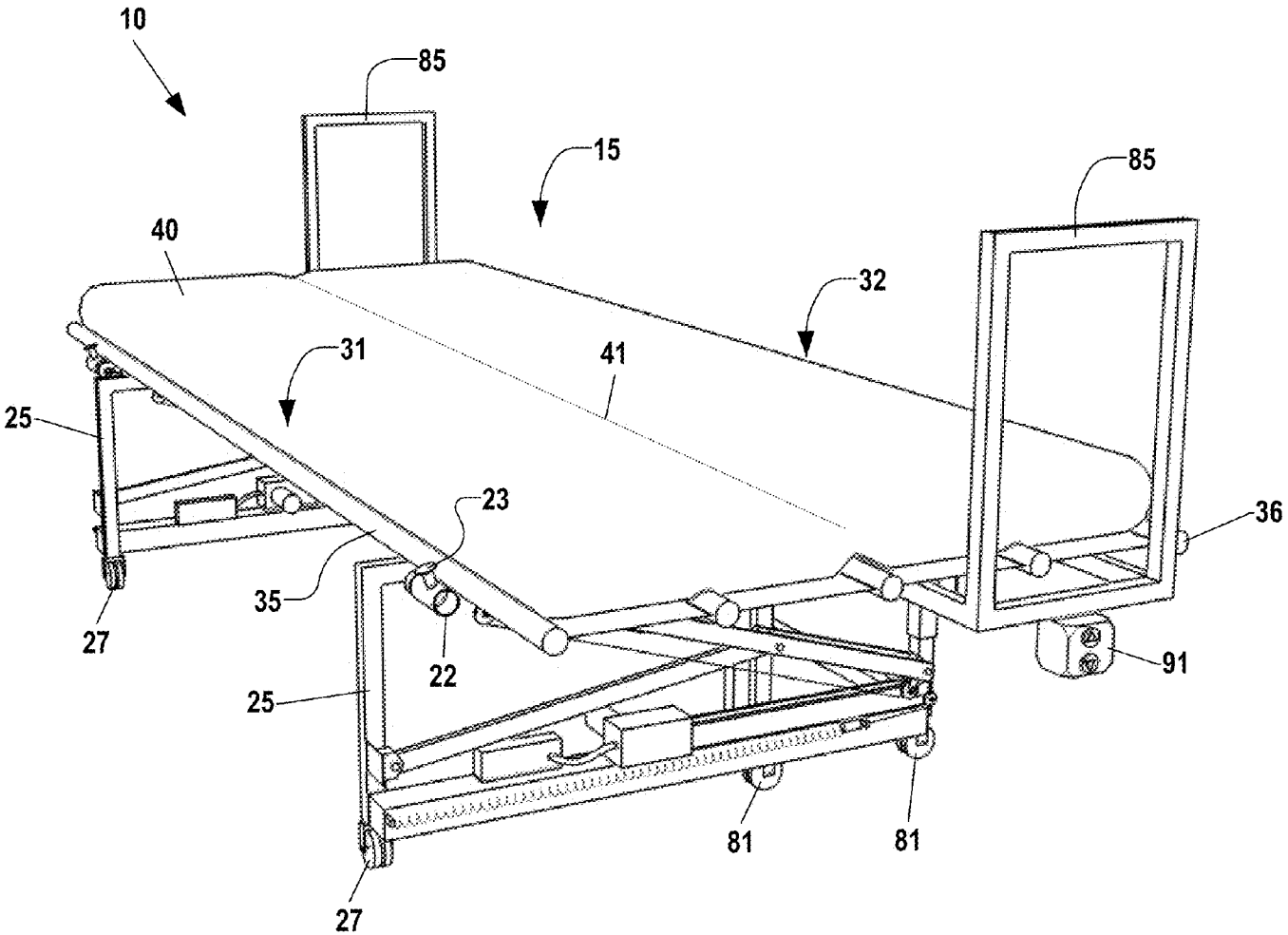
FIG. 8 is a perspective view of the specialized patient rotation stretcher of FIGS. 1-5 in a fully-extended non-storage configuration.
Figure 9:
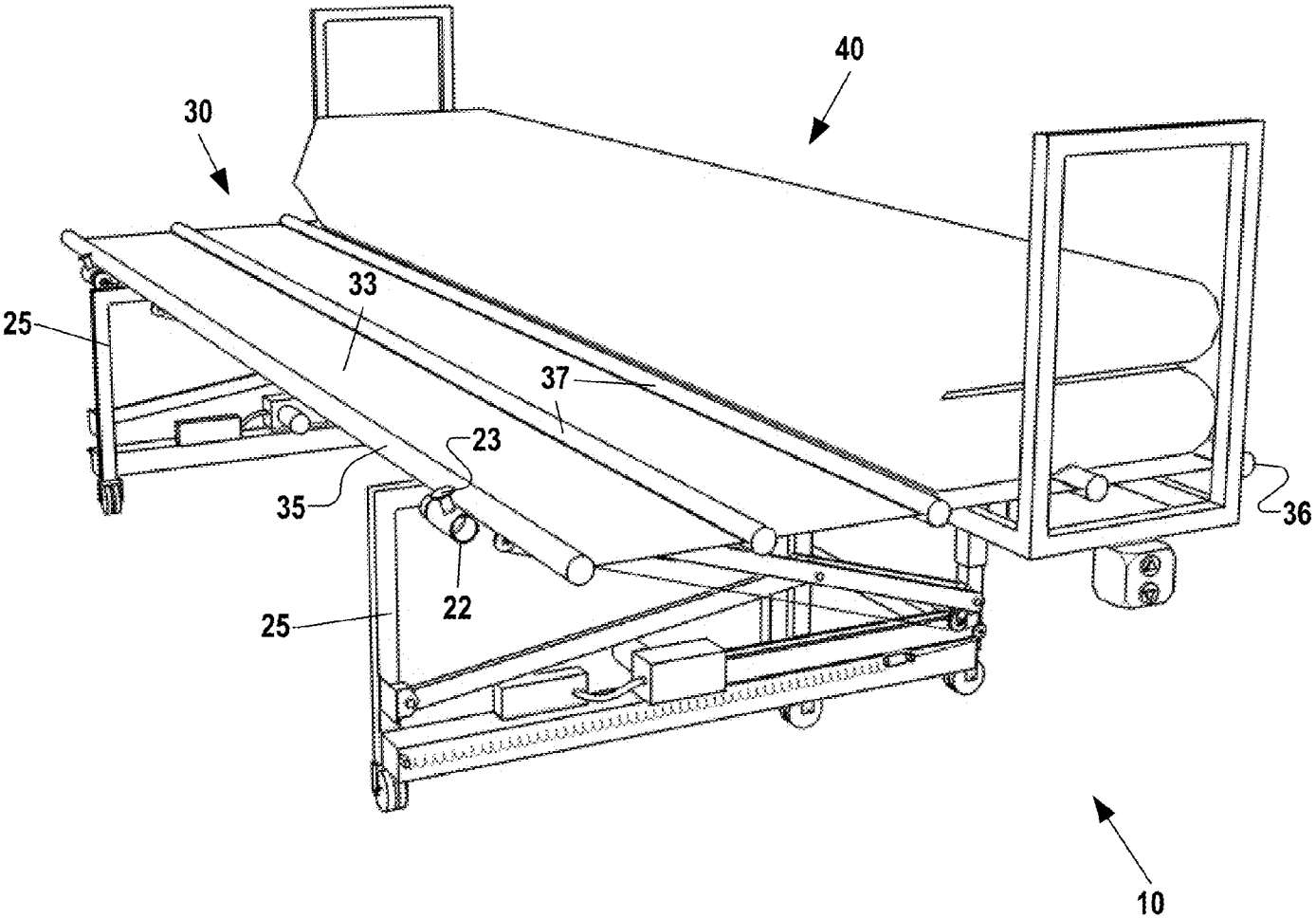
FIG. 9 illustrates a sectional mattress of the specialized patient rotation stretcher of FIGS. 1-5 folded over into a compact storage configuration.
Figure 10:
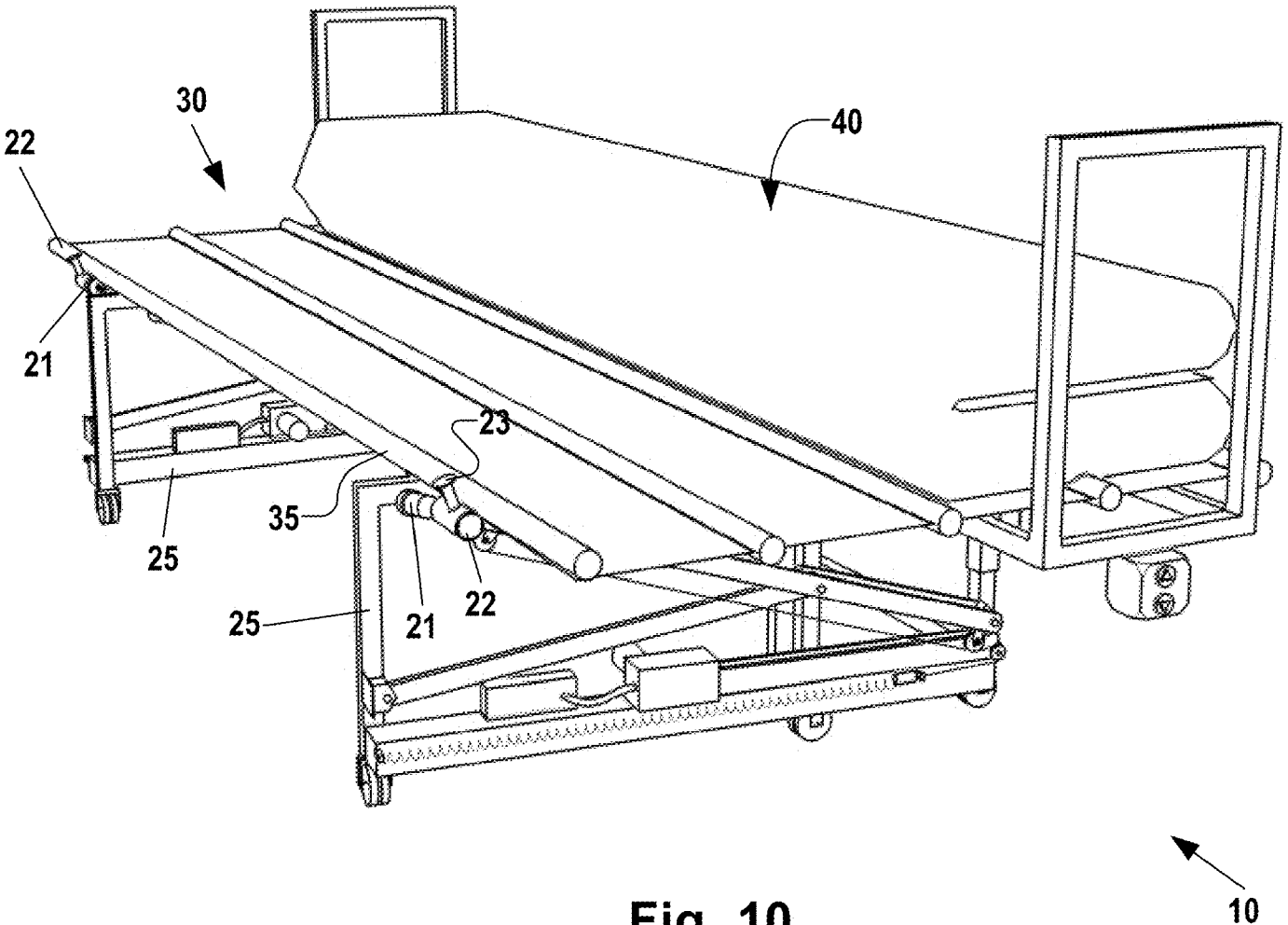
FIGS. 10-12 illustrate the decoupling of the coupling mechanism that connects the lift mechanism to the adjustable side of the patient support litter of the specialized patient rotation stretcher of FIGS. 1-5.
Figure 11:
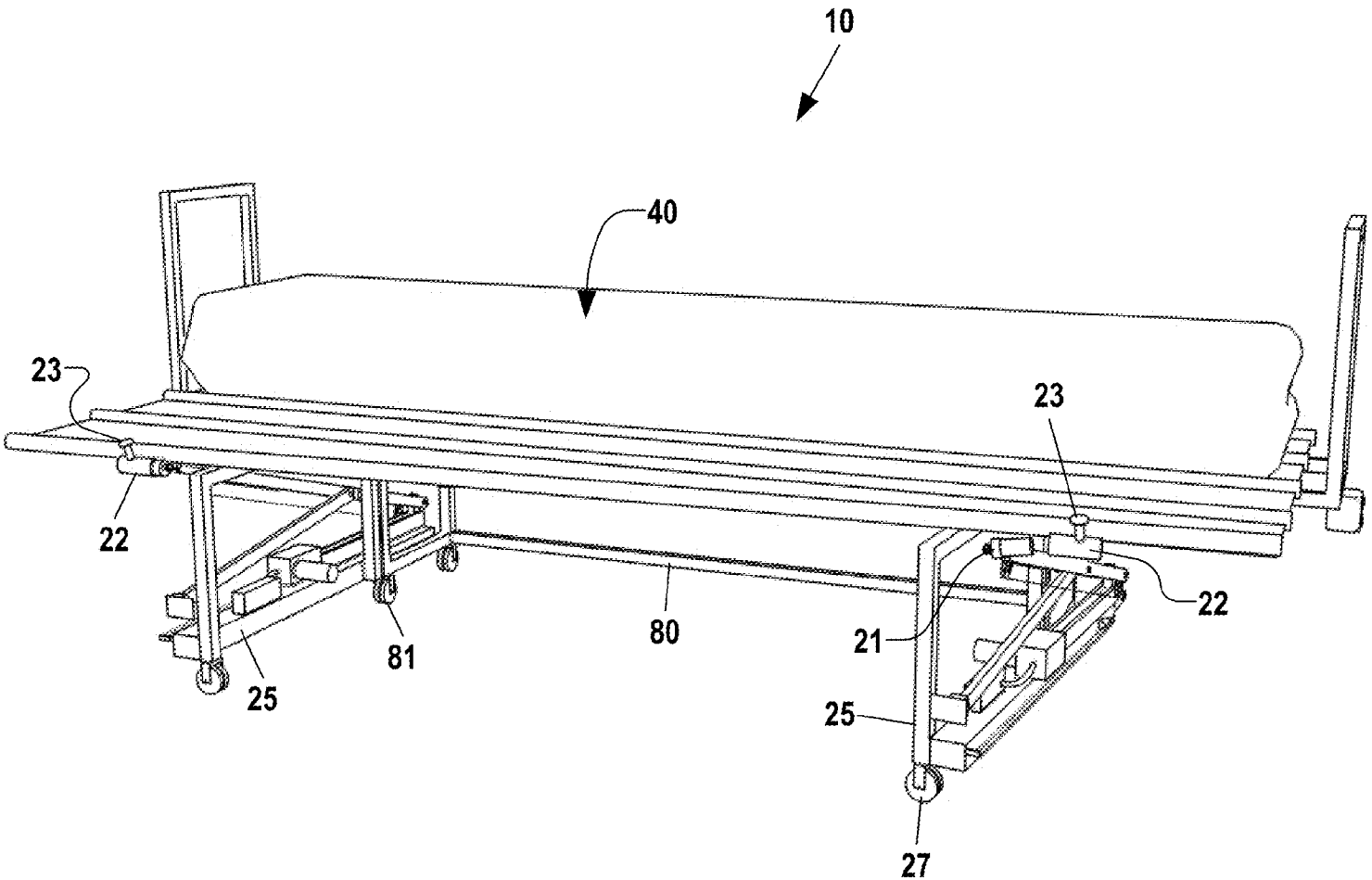

FIGS. 6-7 illustrate connectors 86 each comprising a hook 88 mounted to a sliding bracket or sleeve 87 which is in turn slidingly mounted on one of the vertical support bars 84 of the transport frame or chassis 80. The hook is operable to engage a longitudinal brace or bar 7 of an adjoining patient turning accessory or stretcher 10. FIGS. 6 and 7 illustrate the connector 86 in respectively raised uncoupled and lowered coupled positions with respect to the longitudinal brace or bar 7.

Improvements can be made to prevent a patient from sliding into a crease, gap or trough 9 between the patient turning accessory or stretcher 10 and an adjacent cooperating bed 5.

FIGS. 2 and 8-10 illustrate two control panels 91 that are mounted on both ends—and more particularly on both cantilevered handle subassemblies 85—of the patient turning accessory 10. As illustrated, the control panels 91 comprise a simple pair of raise and lower buttons. Alternative embodiments, which need not be illustrated here, employ a more sophisticated user interface, including graphical user interfaces and touch sensitive screens. In another embodiment, operation of the patient turning accessory 10 may be driven remotely.

For example, a preferred embodiment, again not illustrated in the drawings, enables the control panel of a cooperating bed 5 to communicate through wire or wirelessly with a control unit (not shown) of the patient turning accessory 10. Alternatively, the control panel 91 is operable to communicate with a control unit of the cooperating bed 5. In this embodiment, a single user interface—either the user interface 91 associated with the patient turning accessory 10 or the user interface 8 associated with the cooperating bed 5—can be used to control both support surfaces. In this preferred embodiment, the single user interface provides operator-selectable programmed transfer modes to coordinate and stagger the respective tilting of the patient support surfaces—as illustrated in the incorporated provisional patent application—to facilitate a transfer of a patient from one support surface to the other.

Although each patient support surface is operated to tilt toward the other, the degree and chronological progression of the tilting is preferably staggered, as illustrated both in FIGS. 1-5 and Appendix A of the incorporated provisional patent application. Namely, in a first stage (FIG. 2), the receiving surface is tilted at a greater angle than the transferring surface. In a second stage (FIG. 3), the transferring surface is tilted to a maximum patient transferring angle, and the patient is transferred to the receiving surface (FIG. 4). Then, in a third stage (FIG. 5), the receiving surface is rotated toward a substantially horizontal position at a more rapid pace and a closer-to-horizontal angle than the transferring surface. Finally, in a fourth stage, the transferring surface is rotated back to a substantially horizontal position.

In operation, a health care professional will secure or attach the patient turning accessory or specialized patient rotation stretcher 10 to a tilt-capable bed 5 on which a patient is resting. The health care professional will then operate the control panel or user interface 91 for the stretcher 10 and another control panel or user interface 8 (unless the control panels have been integrated) for the tilt-capable bed 5 to raise both opposite lateral sides of the attached beds. Once the patient is placed in a high tilted position, the health care professional, with minimal effort, can displace (roll or tilt) the patient to transfer the patient to the patient support litter 15 of the stretcher 10. Next, the health care professional will operate the control panel or user interface 91 to lower the patient support litter 15 to a substantially horizontal or lateral position. The same process can be used in reverse to transfer a patient from the stretcher 10 to the tilt-capable bed 5

It will be understood that many modifications could be made to the embodiments disclosed herein and in the incorporated provisional application and its appendices without departing from the spirit of the invention. In the claims, it should be understood that "concave lateral cross-section" does not require a curve or continuous arc. That term also encompasses a cross-section of linear segments or arcs, where the internal upwardly-facing angle between each segment is less than 180 degrees. Also, some of the claims recite the word "litter" in an effort to distinguish those claims from a rigid platform to carry the patient, or from a relatively stiff mattress that fails to cradle the patient as the stretcher tilts.

Having thus described exemplary embodiments of the present invention, it should be noted that the disclosures contained in FIGS. 1-27 are exemplary only, and that various other alternatives, adaptations, and modifications may be made within the scope of the present invention. Accordingly, the present invention is not limited to the specific embodiments illustrated herein, but is limited only by the following claims.

We claim:

1. A patient turning accessory operable to be positioned adjacent a bed for receiving a person from, or transferring a person to, the bed, while turning the person between the supine and prone positions, the patient support accessory comprising:

a mechanically-actuated mattress foundation having a longitudinal adjustable side and a longitudinal relatively fixed side opposite the longitudinal adjustable side;

a mattress mounted over the mattress foundation; and a lift mechanism operable to preferentially raise the longitudinal adjustable side relative to the relatively fixed side of the mattress foundation, in order to tilt the mattress toward the adjacent bed;

wherein relative to its position adjacent the bed, the mattress is operable to rotate from a substantially flat to a tilted position in only one direction;

wherein the patient turning accessory is operable to be transported away from the bed after receiving a person from, or transferring a person to, the bed;

wherein the mattress foundation and mattress, when tilted, assume an upwardly-facing concave lateral cross-section to partially cradle a person being transferred away from or to the mattress; and wherein the mattress foundation includes longitudinally-oriented rigid elongate members that keep the mattress foundation stiff along the longitudinal dimension.

2. The patient turning accessory of claim 1, further comprising:

a transport frame;

wherein the lift mechanism comprises one or more actuator subassemblies;

wherein each actuator subassembly is mounted to an actuator subframe; and wherein each actuator subframe is mounted to the transport frame for movement between an outwardly extended operational position and a retracted storage position.

3. The patient turning accessory of claim 2, wherein each actuator subframe is operable to be pivoted about a vertical axis from the outwardly extended operational position, which is laterally oriented with respect to the transport frame, to the retracted storage position.

4. The patient turning accessory of claim 1, wherein the patient turning accessory has a structure that is symmetric across its lateral midsection, so that the patient turning accessory can be positioned adjacent either a right side, or a left side, of the bed.

5. The patient turning accessory of claim 1, further comprising a pair of control panels, each capable of operating the lift mechanism, mounted adjacent a foot end and adjacent a head end of the patient turning accessory.

6. A patient turning accessory operable to be positioned adjacent a bed for receiving a person from, or transferring a person to, the bed, while turning the person between the supine and prone positions, the patient support accessory comprising:

a mechanically-actuated mattress foundation having a longitudinal adjustable side and a longitudinal relatively fixed side opposite the longitudinal adjustable side;

a mattress mounted over the mattress foundation; and a lift mechanism operable to preferentially raise the longitudinal adjustable side relative to the relatively fixed side of the mattress foundation, in order to tilt the mattress toward the adjacent bed;

wherein relative to its position adjacent the bed, the mattress is operable to rotate from a substantially flat to a tilted position only one direction;

wherein the patient turning accessory is operable to be transported away from the bed after receiving a person from, or transferring a person to, the bed; and wherein the mattress is collapsible along one or more longitudinal fold lines for folding the mattress into a compact storage configuration.

7. The patient turning accessory of claim 6, wherein the mattress foundation is operable to be detached from the lift mechanism and folded over the mattress, when the mattress is folded into a compact storage configuration, to collapse the patient turning accessory into a compact storage configuration.

8. The patient turning accessory of claim 7, further comprising one or more couplers operable to pivotally and detachably couple the lift mechanism to the adjustable side of the mattress foundation.

9. A patient turning accessory operable to be positioned adjacent a bed for receiving a person from, or transferring a person to, the bed, while turning the person between the supine and prone positions, the patient support accessory comprising:

a mechanically-actuated mattress foundation having a longitudinal adjustable side and a longitudinal relatively fixed side opposite the longitudinal adjustable side;

a mattress mounted over the mattress foundation; and a lift mechanism operable to preferentially raise the longitudinal adjustable side relative to the relatively fixed side of the mattress foundation, in order to tilt the mattress toward the adjacent bed, wherein:

the lift mechanism comprises one or more actuator subassemblies coupled to the adjustable side of the mattress support foundation; and wherein each actuator subassembly comprises:

a sliding element;

a sliding guide that confines the movement of the sliding element;

a principal arm having superior and inferior ends, the inferior end of which is hingedly linked to the sliding element, and the superior end of which is coupled to the left longitudinal side or right longitudinal side of the patient support surface; and a secondary arm having superior and inferior ends, the inferior end of which is hingedly linked to a section of the base frame and the superior end of which is hingedly joined to a midsection of the principal arm;

wherein relative to its position adjacent the bed, the mattress is operable to rotate from a substantially flat to a tilted position only one direction; and wherein the patient turning accessory is operable to be transported away from the bed after receiving a person from, or transferring a person to, the bed.

10. The patient turning accessory of claim 9, wherein the principal arm is a telescoping arm.

11. A specialized patient rotation stretcher for receiving a patient from, or transferring a patient to, another patient support surface, while turning the patient between the supine and prone positions, the patient rotation stretcher comprising:

a transport frame;

a mechanically-actuated patient support litter; and a lift mechanism operable to raise and move inward a side of the patient support litter to a substantially vertical orientation to receive a patient from, or transfer a patient to, another adjacently-placed patient support surface, while simultaneously turning the patient between the supine and prone positions;

wherein the lift mechanism comprises one or more actuator subassemblies;

wherein each actuator subassembly is mounted to an actuator subframe;

wherein each actuator subframe is mounted to the transport frame for movement between an outwardly extended operational position and a retracted storage position; and wherein the patient support litter is operable to be detached from the lift mechanism and folded into a compact storage configuration.

12. The specialized patient rotation stretcher of claim 11, wherein:

the patient support litter has a longitudinal adjustable side and a longitudinal relatively fixed side opposite the longitudinal adjustable side; and the lift mechanism is operable to preferentially raise the longitudinal adjustable side relative to the relatively fixed side of the patient support litter, in order to tilt the patient support litter toward the other patient support surface.

13. A specialized patient rotation stretcher for receiving a patient from, or transferring a patient to, another patient support surface, while turning the patient between the supine and prone positions, the patient rotation stretcher comprising:

a transport frame;

a mechanically-actuated patient support litter; and a lift mechanism operable to raise and move inward a side of the patient support litter to a substantially vertical orientation to receive a patient from, or transfer a patient to, another adjacently-placed patient support surface, while simultaneously turning the patient between the supine and prone positions;

wherein the patient support litter, when tilted, assumes an upwardly-facing concave lateral cross-section to partially cradle a person being transferred away from or to the patient rotation stretcher.

14. The specialized patient rotation stretcher of claim 13, further comprising one or more couplers operable to pivotally and detachably couple the lift mechanism to an adjustable side of the patient support litter.

15. A patient turning accessory for receiving a patient from, or transferring a patient to, another patient support surface, while turning the patient between the supine and prone positions, the patient rotation stretcher comprising:

a transport frame;

a mechanically-actuated patient support litter; and a lift mechanism operable to raise and move inward a side of the patient support litter to a substantially vertical orientation to receive a patient from, or transfer a patient to, another adjacently-placed patient support surface, while simultaneously turning the patient between the supine and prone positions;

wherein the lift mechanism comprises one or more actuator subassemblies coupled to an adjustable side of the patient support litter; and wherein each actuator subassembly comprises:

a sliding element;

a sliding guide that confines the movement of the sliding element;

a principal arm having superior and inferior ends, the inferior end of which is hingedly linked to the sliding element, and the superior end of which is coupled to the left longitudinal side or right longitudinal side of the patient support surface; and a secondary arm having superior and inferior ends, the inferior end of which is hingedly linked to a section of the base frame and the superior end of which is hingedly joined to a midsection of the principal arm.

* * * * *